US009169540B2

(12) United States Patent
Takasugi et al.

(10) Patent No.: US 9,169,540 B2
(45) Date of Patent: Oct. 27, 2015

(54) RE-ADDED NI-BASED DUAL MULTI-PHASE INTERMETALLIC COMPOUND ALLOY AND METHOD FOR PRODUCING THE SAME

(75) Inventors: Takayuki Takasugi, Sakai (JP); Yasuyuki Kaneno, Sakai (JP)

(73) Assignee: OSAKA PREFECTURE UNIVERSITY PUBLIC CORPORATION, Osaka (JP)

( * ) Notice: Subject to any disclaimer, the term of this patent is extended or adjusted under 35 U.S.C. 154(b) by 95 days.

(21) Appl. No.: 13/823,849

(22) PCT Filed: Jul. 20, 2011

(86) PCT No.: PCT/JP2011/066466

§ 371 (c)(1), (2), (4) Date: Mar. 29, 2013

(87) PCT Pub. No.: WO2012/039189

PCT Pub. Date: Mar. 29, 2012

(65) Prior Publication Data

US 2013/0189149 A1 Jul. 25, 2013

(30) Foreign Application Priority Data

Sep. 24, 2010 (JP) ..... 2010-213768

(51) Int. Cl.

| | |
|---|---|
| ***C22F 1/10*** | (2006.01) |
| ***C22C 19/03*** | (2006.01) |
| ***B22D 25/06*** | (2006.01) |

(52) U.S. Cl.

CPC ..... *C22C 19/03* (2013.01); *B22D 25/06* (2013.01); *C22F 1/10* (2013.01)

(58) Field of Classification Search

CPC ..... C22C 19/03; C22F 1/10; B22D 25/06

See application file for complete search history.

(56) References Cited

U.S. PATENT DOCUMENTS

| | | | | |
|---|---|---|---|---|
| 8,696,833 | B2 * | 4/2014 | Takasugi et al. | 420/460 |
| 2008/0175745 | A1 | 7/2008 | Takasugi et al. | |
| 2009/0120543 | A1 | 5/2009 | Takasugi et al. | |
| 2011/0142714 | A1 | 6/2011 | Harada et al. | |

FOREIGN PATENT DOCUMENTS

| | | | |
|---|---|---|---|
| JP | 2006-045654 | A | 2/2006 |
| JP | 2006-299403 | A | 11/2006 |

(Continued)

OTHER PUBLICATIONS

Caron, Pierre, and Tasadduq Khan. "Evolution of Ni-based superalloys for single crystal gas turbine blade applications." Aerospace Science and Technology 3.8 (1999): 513-523.*

(Continued)

*Primary Examiner* — Jessee Roe

(74) *Attorney, Agent, or Firm* — Birch, Stewart, Kolasch & Birch, LLP

(57) ABSTRACT

The present invention provides an Ni-based intermetallic compound alloy having excellent hardness. The present invention provides an Ni-based dual multi-phase intermetallic compound alloy comprising Ni as a main component, and 5 to 12 atomic % of Al, 11 to 17 atomic % of V and 1 to 5 atomic % of Re, and having a dual multi-phase microstructure including a primary precipitate $L1_2$ phase and a ($L1_2$+$D0_{22}$) eutectoid microstructure.

2 Claims, 12 Drawing Sheets

(56) References Cited

FOREIGN PATENT DOCUMENTS

| | | | |
|---|---|---|---|
| JP | 2009-197254 | A | 9/2009 |
| JP | 2009-215649 | A | 9/2009 |
| JP | 2009-255170 | A | 11/2009 |
| JP | 2010-031299 | A | 2/2010 |
| WO | WO 2007/086185 | A1 | 8/2007 |

OTHER PUBLICATIONS

English Abstract and English Machine Translation of Takasugi et al. (JP 2009-215649) (Sep. 24, 2009).*

Davis, Joseph R., ed. Nickel, cobalt, and their alloys. ASM international, 2000.*

International Search Report, issued in PCT/JP2011/066466, mailed Oct. 25, 2011.

Lapin et al., "Effect of V and Re additions on the creep properties of γ/γ-α eutectic composites", Journal de Physique IV, vol. 3 (1993) pp. 1753-1756.

Miyazaki et al., "Evaluation of Partitioning Ratios of Re Atoms in Ni—Al—Re-X(X:Cr, Mo, W, Ti, Ta, Nb, Co)", Quaternary Alloys, vol. 80, No. 2 (1994) pp. 78-83.

* cited by examiner 6. 5Ta (1) No. 3—A (2) No. 3—B (3) No. 3—C (1)

(2)

RE-ADDED NI-BASED DUAL MULTI-PHASE INTERMETALLIC COMPOUND ALLOY AND METHOD FOR PRODUCING THE SAME

TECHNICAL FIELD

The present invention relates to an Ni-based dual multi-phase intermetallic compound alloy to which Re is added and to a method for producing the same.

BACKGROUND ART

In recent years, environmental disruption has been at issue, and energy saving and $CO_2$ reduction technologies have been attracting attention. Accordingly, further improvement in the combustion efficiency of internal combustion engines has been desired, and development of materials having improved high-temperature properties has been demanded.

For such a demand, (1) Ni-based superalloys and (2) Ni-based dual multi-phase intermetallic compound alloys are being developed as the materials having improved high-temperature properties.

The Ni-based superalloys mentioned as (1) have a γ phase (Ni solid solution phase), which is a parent phase, and a γ' phase, which has dispersed and precipitated in the parent phase. The γ' phase is an intermetallic compound having a basic composition of $Ni_3Al$ ($L1_2$ phase) and accounts for approximately 60 to 70 vol % of the constituent phases.

The alloys have been developed into ordinary cast alloys, into directionally solidified alloys, and into single crystal alloys. The single crystal alloys have been developed into first generation alloys, into second generation alloys containing approximately 3% by weight of Re, into third generation alloys containing 5 to 6% by weight of Re, into fourth generation alloys containing 2 to 3% by weight of a noble metal such as Ru, and into fifth generation alloys containing 5 to 6% by weight of a noble metal.

As an Ni-based superalloy for a directionally solidified material, for example, an Ni-based directionally solidified superalloy containing C, B, Hf, Co, Ta, Cr, W, Al and Re, and a balance made up of Ni and inevitable impurities is known (see Patent Document 1, for example).

This alloy can contain Ti, Nb, V and Zr as an optional component and is improved in strength in the solidification direction and in strength at grain boundaries by adjusting the amounts of elements composing the γ phase as a parent phase and the γ' phase as a precipitate phase, and by adjusting the amounts of elements for strengthening the grain boundaries.

Meanwhile, as an Ni-based single crystal superalloy having both high-temperature strength and oxidation resistance at high temperature in practical use in a balanced manner, an Ni-based single crystal superalloy containing Al, Ta, W, Re, Cr and Ru as main elements is known (see Patent Document 2, for example).

For this alloy, the high-temperature strength (creep strength) is improved by determining the composition ratio among the elements in the most suitable range, and thereby controlling the lattice constant of the parent phase (γ phase) and the lattice constant of the precipitate phase (γ' phase) to the most appropriate values.

These Ni-based superalloys are developed from the viewpoint of high-temperature strength and casting, because they are mainly applied to turbine blades in jet engines and the like, and therefore elements preferable in this view are added to the composition. As described above, the Ni-based superalloy includes a γ phase as a parent phase and a γ' phase as a precipitate phase. In this regard, it is explained that Re is dissolved in the γ phase (solid solution phase) and improves the creep strength (see Patent Documents 1 and 2, for example). It is also explained that Ta as well as W is dissolved in the γ phase and a part thereof is dissolved in the γ' phase, and improves the creep strength (see Patent Document 2, for example). It is further explained that V reduces the high-temperature strength and therefore the amount thereof is preferably 1% by weight or less (see Patent Documents 1 and 2, for example).

However, the γ phase, which is a metallic phase accounts for approximately 30 to 40 vol % or more of the constituent phases of the Ni-based superalloy, and therefore the drawback is that the melting point and the high-temperature creep strength of the superalloy are low. In addition, while the development from the viewpoint of high-temperature strength has been advanced, development from the viewpoint of hardness has not been advanced.

Meanwhile, the Ni-based dual multi-phase intermetallic compound alloys mentioned as (2) above are expected to be developed as alloys that can solve such problems. The Ni-based dual multi-phase intermetallic compound alloys are multi-phase alloys obtained by combining $Ni_3X$-type intermetallic compounds belonging to geometrically closed packed crystal structures with crystallographic coherency. For example, an Ni-based dual multi-phase intermetallic compound alloy is composed of an $Ni_3Al$ intermetallic compound phase called as the γ' phase and an $Ni_3V$ intermetallic compound phase.

FIG. 17 is a drawing for illustrating a microstructure of the Ni-based dual multi-phase intermetallic compound alloy. In FIG. 17, (1) shows an exemplary SEM photograph for illustrating a microstructure of the Ni-based dual multi-phase intermetallic compound alloy ($Ni_{75}Al_8V_{14.5}Nb_{2.5}$), and (2) shows schematic views of crystal structures ($Ni_3Al$, $Ni_3V$) composing the microstructure of the Ni-based dual multi-phase intermetallic compound alloy.

As shown in FIG. 17, the Ni-based dual multi-phase intermetallic compound alloy is composed of a microstructure formed with crystallographic coherency and a nanostructure formed in channels of the microstructure (see FIG. 17 (1)). The former microstructure is composed of a primary precipitate $L1_2$ phase ($Ni_3Al$ shown in FIG. 17 (2)), and the nanostructure is composed of an eutectoid structure consisting of an $L1_2$ phase and a $D0_{22}$ phase ($Ni_3Al$ and $Ni_3V$ shown in FIG. 17 (2)).

The Ni-based dual multi-phase intermetallic compound alloy is composed of an upper multi-phase microstructure formed of the primary precipitate $L1_2$ phase precipitating in an A1 phase (Ni solid solution phase) through a heat treatment at a temperature higher than the eutectoid point; and a lower multi-phase microstructure formed of two phases including the $L1_2$ phase and the $D0_{22}$ phase generated by eutectoid transformation of the A1 phase through a subsequent heat treatment at a temperature lower than the eutectoid point.

As described above, the Ni-based dual multi-phase intermetallic compound alloy is formed from multi-phased $Ni_3X$-type intermetallic compounds having excellent properties. Accordingly, the Ni-based dual multi-phase intermetallic compound alloy has superior properties to alloys composed of a single intermetallic compound phase and is expected as an alloy that can allow wide-ranging microstructural control (see Patent Document 3). The Ni-based dual multi-phase intermetallic compound alloys are being developed from the viewpoint of hardness as well as of high-temperature strength, for example.

As a specific example of an Ni-based dual multi-phase intermetallic compound alloy showing excellent hardness not only at room temperature but also at high temperature, an alloy containing Ni as a main component, and Al, V, Ta and/or W, Nb, Co, Cr and B is known (Nb, Co and Cr are optional components) (see Patent Document 4).

In addition, as an Ni-based dual multi-phase intermetallic compound alloy increased in surface hardness, an Ni-based dual multi-phase intermetallic compound alloy is known in which a base material is an alloy containing Ni as a main component, and Al, V, Nb, Ti, Co, Cr and B (Nb, Ti, Co and Cr are optional components), and the base material is surface-treated by at least one of nitridation and carburization (see Patent Document 5).

RELATED ART DOCUMENTS

Patent Documents

Patent Document 1: Japanese Unexamined Patent Publication No. 2006-45654
Patent Document 2: Japanese Unexamined Patent Publication No. 2010-031299
Patent Document 3: Pamphlet of WO 2007/086185
Patent Document 4: Japanese Unexamined Patent Publication No. 2009-215649
Patent Document 5: Japanese Unexamined Patent Publication No. 2009-197254

SUMMARY OF THE INVENTION

Problems to be Solved by the Invention

Though having excellent hardness, however, the Ni-based dual multi-phase intermetallic compound alloys mentioned in the background art are desired to be improved in their properties. In some cases, for example, an increased Ta content leads to improved hardness, but an inversely decreased Al content may lead to failure to obtain sufficient harness at high temperature. In other cases, an increased Ta content may lead to generation of second phase particles (dispersed substances) which are not preferable in terms of strength properties. Thus, the improvement in hardness by the Ta addition is considered limited, and it has been desired to improve the hardness of the Ni-based dual multi-phase intermetallic compound alloys by adding an element other than Ta, for example.

In view of the above-described circumstances, the present invention has been achieved to provide an Ni-based dual multi-phase intermetallic compound alloy having excellent hardness.

The present invention provides an Ni-based dual multi-phase intermetallic compound alloy comprising Ni as a main component, and 5 to 12 atomic % of Al, 11 to 17 atomic % of V and 1 to 5 atomic % of Re, and having a dual multi-phase microstructure including a primary precipitate $L1_2$ phase and a ($L1_2$+$D0_{22}$) eutectoid microstructure.

Effects of the Invention

The inventors of the present invention have paid attention to the fact that a conventional Ni-based dual multi-phase intermetallic compound alloy contains elements (Ta, Nb, Ti, for example) which replace the element X of an $Ni_3X$-type intermetallic compound, and originated inclusion of an element which replaces the element Ni, not the element X in the Ni-based dual multi-phase intermetallic compound alloy.

Then, the inventors have made intensive studies and, as a result, found the following to complete the present invention:

(1) An Ni-based dual multi-phase intermetallic compound alloy having a fine microstructure can be obtained by including Re (3 atomic %, for example) in an Ni-based dual multi-phase intermetallic compound alloy containing Ni, Al and V; and (2) The Ni-based dual multi-phase intermetallic compound alloy containing Re can be improved in hardness while maintaining its dual multi-phase microstructure by a heat treatment.

The present invention provides an Ni-based dual multi-phase intermetallic compound alloy having excellent hardness.

In addition, the present invention provides an Ni-based dual multi-phase intermetallic compound alloy having excellent workability (machinability, for example), because the alloy can be worked while the material is not hardened, that is, while the material is easily worked (cutting, for example), and then increased in hardness by a heat treatment.

Hereinafter, various embodiments of the present invention will be exemplified. Configurations shown in the following description are merely exemplifications and the scope of the present invention is not limited thereto.

MODE FOR CARRYING OUT THE INVENTION

Figure 1:
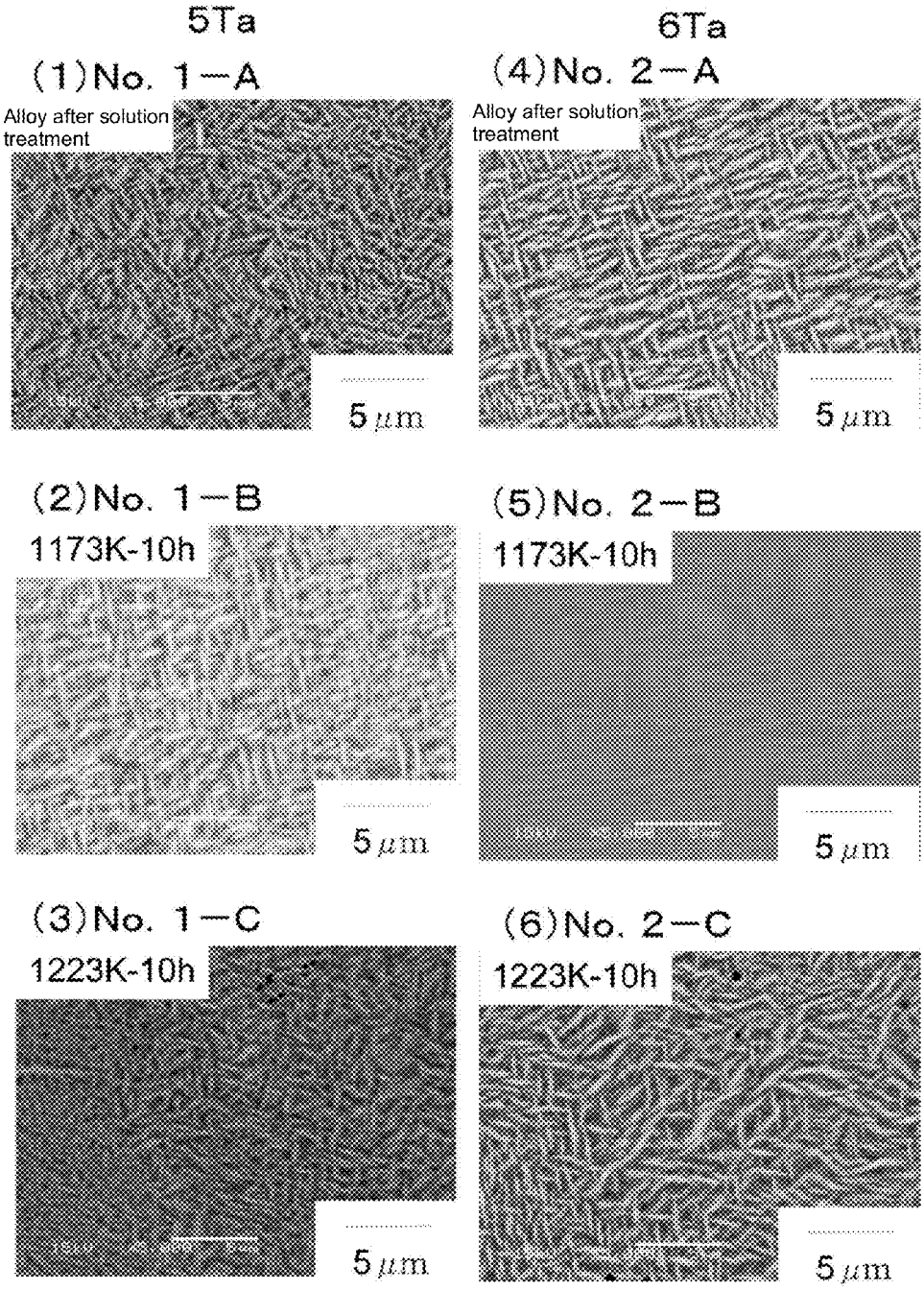
FIG. 1 shows SEM photographs of Sample No. 1 and Sample No. 2 according to comparative examples.

An Ni-based dual multi-phase intermetallic compound alloy according to the present invention contains Ni as a main component, and 5 to 12 atomic % of Al, 11 to 17 atomic % of V and 1 to 5 atomic % of Re, and has a dual multi-phase microstructure including a primary precipitate $L1_2$ phase and a ($L1_2$+$D0_{22}$) eutectoid microstructure. The Ni-based dual multi-phase intermetallic compound alloy may further contain 10 to 1000 ppm by weight of B with respect to the total weight of a composition of 100 atomic % in total including Ni, Al, V and Re in the above-specified contents.

In an embodiment of the present invention, when containing 1 to 5 atomic % of Re, the Ni-based dual multi-phase intermetallic compound alloy may be the one containing Ni as a main component, and 8 to 12 atomic % of Al, 13 to 17 atomic % of V and 1 to 5 atomic % of Re. Even in the embodiment containing 1 to 5 atomic % of Re, the Ni-based dual multi-phase intermetallic compound alloy may further contain 10 to 1000 ppm by weight of B with respect to the total weight of a composition of 100 atomic % in total including Ni, Al, V and Re in the above-specified contents.

According to this embodiment, for example, an Ni-based dual multi-phase intermetallic compound alloy is provided which can be significantly improved in hardness by giving a heat treatment (for example, heat treatment at 1073 to 1273 K). In addition, the Ni-based dual multi-phase intermetallic compound alloy can be significantly improved in hardness while maintaining its fine dual multi-phase microstructure.

Furthermore, the Ni-based dual multi-phase intermetallic compound alloy shows significantly high hardness at the temperature of the above-mentioned heat treatment and therefore is suitable also for use at the temperature of the heat treatment, that is, at high temperature.

The heat treatment referred to means a heat treatment for transforming the A1 phase formed in the channels of the primary precipitate $L1_2$ phase so that the $L1_2$ phase and the $D0_{22}$ phase are formed. This heat treatment includes an aging heat treatment (so-called artificial aging) as a treatment for accelerating formation of such a microstructure and a heat treatment for forming lower multi-phase microstructure to be described later (second heat treatment) as a treatment for forming such a microstructure.

In the case of the above-described embodiment, the temperature of the heat treatment is preferably 1073 to 1273 K, and more preferably 1098 to 1198 K (1123 K±25 K or 1173 K±25 K). Within these temperature ranges, the heat treatment can significantly increase the hardness of the alloy, and the Ni-based dual multi-phase intermetallic compound alloy can be used while maintaining the hardness.

Preferably, the period of time of the heat treatment is 5 to 10 hours. Within the time range, the heat treatment at 1148 to 1198 K, for example, can achieve a Vickers' hardness of approximately 660 HV.

In an embodiment of the present invention, the Ni-based dual multi-phase intermetallic compound alloy may further contain Ta. In the case of the Ni-based dual multi-phase intermetallic compound alloy containing Ta, specifically, the Ni-based dual multi-phase intermetallic compound alloy may be the one containing Ni as a main component, and 5 to 9 atomic % of Al, 11 to 15 atomic % of V, 3 to 7 atomic % of Ta and 1 to 5 atomic % of Re. Even in the embodiment containing Ta, the Ni-based dual multi-phase intermetallic compound alloy may further contain 10 to 1000 ppm by weight of B with respect to the total weight of a composition of 100 atomic % in total including Ni, Al, V and Re in the above-specified contents.

According to this embodiment, for example, an Ni-based dual multi-phase intermetallic compound alloy is provided which can be significantly improved in hardness by giving a heat treatment and besides which has excellent hardness even before the heat treatment.

In the case of this embodiment, the temperature of the heat treatment is preferably 1073 to 1273 K, and the period of time of the heat treatment is preferably 2 to 24 hours.

Such a heat treatment can achieve a more improved Vickers' hardness (approximately 780 HV, for example).

The Ni-based dual multi-phase intermetallic compound alloy of this embodiment can also be significantly improved in hardness by the heat treatment while maintaining its fine dual multi-phase microstructure and is suitable for use at high temperature (temperature of 1073 to 1273 K, for example).

In an embodiment of the present invention, a refractory part may be formed from an Ni-based dual multi-phase intermetallic compound alloy of the present invention.

As described above, the Ni-based dual multi-phase intermetallic compound alloy of the present invention is increased in hardness at the temperature of the heat treatment, for example, at a temperature of 1073 to 1273 K, and therefore suitable for use at high temperature (temperature of the heat treatment of 1073 to 1273 K, for example). Accordingly, the refractory part (for example, refractory bolt) formed from the Ni-based dual multi-phase intermetallic compound alloy has excellent hardness even at high temperature.

According to another aspect, the present invention provides a method for producing an Ni-based dual multi-phase intermetallic compound alloy, the method including casting by slow cooling a molten metal containing Ni as a main component, and 5 to 12 atomic % of Al, 11 to 17 atomic % of V and 1 to 5 atomic % of Re.

In an embodiment of the production method of the present invention, the molten metal may contain Ni as a main component, and 8 to 12 atomic % of Al, 13 to 17 atomic % of V and 1 to 5 atomic % of Re. Alternatively, the molten metal may contain Ni as a main component, and 5 to 9 atomic % of Al, 11 to 15 atomic % of V, 3 to 7 atomic % of Ta and 1 to 5 atomic % of Re. Furthermore, the molten metal may further contain 10 to 1000 ppm by weight of B with respect to the total weight of a composition of 100 atomic % in total including Ni, Al, V and Re in the above-specified contents or including Ni, Al, V, Re and Ta in the above-specified contents.

According to the production method of the present invention, it is possible to produce an Ni-based dual multi-phase intermetallic compound alloy having excellent hardness. In addition, according to the production method of the present invention, it is possible to provide a method for producing an Ni-based dual multi-phase intermetallic compound alloy having excellent machinability (cuttability, for example), because it is possible to produce an Ni-based dual multi-phase intermetallic compound alloy that can be worked while the material is not hardened, that is, while the material is easily worked (cutting, for example), and then increased in hardness by a heat treatment.

In an embodiment of the production method of the present invention, a solution heat treatment at 1503 to 1603 K may be performed after the casting.

According to this embodiment, the element V is dissolved at a temperature of 1503 to 1603 K to form an A1 phase (Ni solid solution phase) so that a primary precipitate $L1_2$ phase is formed, and further a dual multi-phase microstructure (microstructure of the primary precipitate $L1_2$ phase and a ($L1_2$+$D0_{22}$) eutectoid microstructure) is formed through the subsequent cooling. Thus, the present invention provides a method for producing an Ni-based dual multi-phase intermetallic compound alloy having a fine and uniform dual multi-phase microstructure.

Here, the solution heat treatment may serve as the step of heat-treating the alloy casted at a temperature at which the primary precipitate $L1_2$ phase and the A1 phase coexist (heat treatment for forming upper multi-phase microstructure (first heat treatment) as referred to in the description) or serve as a homogenization heat treatment.

In an embodiment of the production method of the present invention, an aging heat treatment at a temperature of 1073 to 1273 K may be performed after the solution heat treatment.

According to this embodiment, there is provided a method for producing an Ni-based dual multi-phase intermetallic compound alloy which is significantly improved in hardness while maintaining its fine dual multi-phase microstructure.

The embodiments shown herein may be combined with one another. In this description, "A to B" means that numerical values A and B are included in the range. (It should be noted that the unit atomic % may be also referred to as at. %.)

Hereinafter, each element in these embodiments will be described in detail.

Specifically, the Ni content (content percentage) is preferably 70 to 74 at. %, and more preferably 71 to 73 at. %. When the Ni content is in this range, the ratio between the total of the (Ni, Re) contents and the total of the (Al, V, Ta) contents will be close to 3:1, facilitating the formation of the dual multi-phase microstructure.

For example, the specific Ni content is 70, 70.5, 71, 71.5, 72, 72.5, 73, 73.5 or 74 at. %. The Ni content may range between any two of the numeral values exemplified as the specific contents.

The specific Al content is 5 to 12 at. %. In the case where the Ni-based dual multi-phase intermetallic compound alloy does not contain Ta, the Al content is preferably 8 to 12 at. %, and more preferably 9 to 11 at. %. In the case where the Ni-based dual multi-phase intermetallic compound alloy contains Ta, the Al content is preferably 5 to 9 at. %, and more preferably 6 to 8 at. %.

For example, the Al content is 5, 5.5, 6, 6.5, 7, 7.5, 8, 8.5, 9, 9.5, 10, 10.5, 11, 11.5 or 12 at. %. The Al content may range between any two of the numeral values exemplified as the specific contents.

The specific V content is 11 to 17 at. %. In the case where the Ni-based dual multi-phase intermetallic compound alloy does not contain Ta, the V content is preferably 13 to 17 at. %, and more preferably 14 to 16 at. %. In the case where the Ni-based dual multi-phase intermetallic compound alloy contains Ta, the V content is preferably 11 to 15 at. %, and more preferably 12 to 14 at. %.

For example, the V content is 11, 11.5, 12, 12.5, 13, 13.5, 14, 14.5, 15, 15.5, 16, 16.5 or 17 at. %. The V content may range between any two of the numeral values exemplified as the specific contents.

Specifically, the Re content is 1 to 5 at. %, and preferably 2 to 4 at. %. For example, the Re content is 1, 1.5, 2, 2.5, 3, 3.5, 4, 4.5 or 5 at. %. The Re content may range between any two of the numeral values exemplified as the specific contents.

Specifically the Ta content is 3 to 7 at. %, and preferably 4 to 6 at. %. For example, the Ta content is 3, 3.5, 4, 4.5, 5, 5.5, 6, 6.5 or 7 at. %. The Ta content may range between any two of the numeral values exemplified as the specific contents.

B is an optional component, and in the case where the Ni-based dual multi-phase intermetallic compound alloy contains B, the specific B content is 10 to 1000 ppm by weight. For example, the B content is 10, 50, 100, 150, 200, 250, 300, 350, 400, 450, 500, 550, 600, 650, 700, 750, 800, 850, 900, 950 or 1000 ppm by weight. The B content may range between any two of the numeral values exemplified as the specific contents.

The specific B content is with respect to the total weight of the composition of 100 at. % in total including Ni, Al, V, Re and Ta (Ta is optional).

Next, the microstructure of the Ni-based dual multi-phase intermetallic compound alloy will be described. The Ni-based dual multi-phase intermetallic compound alloy of the present invention has the same structure as the Ni-based dual multi-phase intermetallic compound alloy shown in FIG. 17.

That is, the Ni-based dual multi-phase intermetallic compound alloy of the present invention has a dual multi-phase microstructure including a primary precipitate $L1_2$ phase and a ($L1_2$+$D0_{22}$) eutectoid microstructure. The primary precipitate $L1_2$ phase is a microstructure formed at a temperature higher than the eutectoid point (a microstructure composed of the primary precipitate $L1_2$ phase formed at a temperature higher than the eutectoid point and an A1 phase in channels of the primary precipitate $L1_2$ phase is referred to as "upper multi-phase microstructure"). On the other hand, the ($L1_2$+$D0_{22}$) eutectoid microstructure is a lower multi-phase microstructure composed of an $L1_2$ phase and a $D0_{22}$ phase formed through decomposition of the A1 phase in the channels of the primary precipitate $L1_2$ phase at a temperature lower than the eutectoid point.

Here, the temperature higher than the eutectoid point means a temperature at which the primary precipitate $L1_2$ phase and the A1 phase coexist, and the eutectoid point is an upper limit of the temperature at which the A1 phase is transformed (decomposed) into the $L1_2$ phase and the $D0_{22}$ phase.

The Ni-based dual multi-phase intermetallic compound alloy having such a microstructure is produced by the following production method.

First, raw metals are weighed so that each element accounts for the above-described proportion, and then melted by heating. Then, the resulting molten metal is casted by cooling.

The cooling of the molten metal in the casting is performed by slow cooling, for example. In the case of the slow cooling, the molten metal solidified will be exposed for a relatively long period of time to the temperature at which the primary precipitate $L1_2$ phase and the A1 phase coexist, and then will be exposed for a long period of time also to the temperature lower than the eutectoid point at which the A1 phase is decomposed into the $L1_2$ phase and the $D0_{22}$ phase. Thus, the upper multi-phase microstructure including the primary precipitate $L1_2$ phase and the A1 phase is formed, and further the lower multi-phase microstructure including the $L1_2$ phase and the $D0_{22}$ phase obtained through the decomposition of the A1 phase is formed.

The slow cooling is performed by furnace cooling, for example. That is, the above-mentioned materials are melted by heating, and then the resulting molten metal is left untouched in the furnace.

In addition, the Ni-based dual multi-phase intermetallic compound alloy having the above-described microstructure may be produced by giving a heat treatment after the casting.

For example, a solution heat treatment at 1503 to 1603 K is performed after the casting (that is, a solution heat treatment for formation of a single A1 phase), and then the cooling is performed to produce the Ni-based dual multi-phase intermetallic compound alloy. The primary precipitate $L1_2$ phase precipitates spontaneously, and then the A1 phase is decomposed into the $L1_2$ phase and the $D0_{22}$ phase, producing the Ni-based dual multi-phase intermetallic compound alloy. In addition, as disclosed in Patent Documents 3 and 4, the Ni-based dual multi-phase intermetallic compound alloy may be produced by giving a first heat treatment at a temperature at which the primary precipitate $L1_2$ phase and the A1 phase coexist to an alloy material (for example, ingot) obtained through melting and solidification (upper multi-phase microstructure formation), and after the first heat treatment, decomposing the A1 phase into the $L1_2$ phase and the $D0_{22}$ phase by cooling (lower multi-phase microstructure formation).

Alternatively, the Ni-based dual multi-phase intermetallic compound alloy may be produced by giving a first heat treatment at a temperature at which the primary precipitate $L1_2$ phase and the A1 phase coexist to an alloy material (for example, ingot) obtained through melting and solidification (upper multi-phase microstructure formation), and then cooling the material to a temperature at which the $L1_2$ phase and the $D0_{22}$ phase coexist (natural cooling such as air cooling and furnace cooling or forced cooling such as water cooling) or giving a second heat treatment at the temperature to transform the A1 phase into the ($L1_2$+$D0_{22}$) eutectoid microstructure (upper multi-phase microstructure formation).

In the case of the Ni-based dual multi-phase intermetallic compound alloy of the present invention, the first heat treatment is performed at a temperature of 1503 to 1603 K, for example. Specifically, the first heat treatment is performed at a temperature of 1503 K for approximately 5 to 200 hours.

The second heat treatment is performed at a temperature of 1123 to 1273 K, for example. Specifically, the second heat treatment is performed at a temperature of 1203 K for approximately 5 to 200 hours.

In addition, a solution heat treatment at 1503 to 1603 K may be performed after the casting or after the first or (and) second heat treatment(s). The solution heat treatment is performed at a temperature of 1553 K for approximately 5 hours, for example. The cooling after the solution heat treatment may be natural cooling such as air cooling or forced cooling such as water cooling. For example, the cooling may be performed by furnace cooling.

The solution heat treatment may serve as the first heat treatment or a homogenization heat treatment. Reversely, the first heat treatment or the homogenization heat treatment may serve as the solution heat treatment.

In addition, an aging heat treatment may be further performed after the casting, after the first or (and) second heat treatment(s) or after the solution heat treatment performed in addition to these treatments. The aging heat treatment is performed in the same temperature range as in the second heat treatment, because it is performed for transforming (decomposing) the A1 phase formed in channels of the primary precipitate $L1_2$ phase of the Ni-based dual multi-phase intermetallic compound alloy to form the $L1_2$ phase and the $D0_{22}$ phase. In order to accelerate the formation of the $L1_2$ phase and the $D0_{22}$ phase, the aging heat treatment is preferably performed at a temperature of 1123 to 1273 K.

In the description, the aging heat treatment may be also referred to as heat treatment for lower phases (heat treatment for forming the lower multi-phase microstructure).

(Effect Demonstration Experiment 1)

Next, Effect Demonstration Experiment 1 will be described. In the following experiment, cast materials were prepared and given (1) solution heat treatment or (2) solution heat treatment and heat treatment for forming lower multi-phase microstructure (corresponding to the above-mentioned aging heat treatment) to give Ni-based dual multi-phase intermetallic compound alloys in the condition of (1) or (2), and the resulting alloys were examined for their properties by SEM microstructure observation, hardness measurement and X-ray measurement.

(Preparation of Alloys)

Cast materials (alloys in the form of a small button having a diameter of 30 to 50 mm) were prepared by melting and casting raw metals of Ni, Al, V, Ta and Re (each having a purity of 99.9% by weight), and B in the proportions shown as No. 1 to No. 5 in Table 1 in a mold in an arc melting furnace.

A melting chamber of the arc melting furnace was evacuated, and then the atmosphere in the arc melting furnace was replaced with an inert gas (argon gas). Non-consumable tungsten electrodes were employed as electrodes of the furnace, and a water-cooling copper hearth was employed as the mold.

TABLE 1

| Sample No. | Ni | Al | V | Ta | Re | B | remarks: name of sample |
|---|---|---|---|---|---|---|---|
| No. 1 | 75 | 6 | 14 | 5 | 0 | 50 | 5Ta |
| No. 2 | 75 | 6 | 13 | 6 | 0 | 50 | 6Ta |
| No. 3 | 75 | 5.5 | 13 | 6.5 | 0 | 50 | 6.5Ta |
| No. 4 | 72 | 10 | 15 | 0 | 3 | 50 | 3Re |
| No. 5 | 72 | 7 | 13 | 5 | 3 | 50 | 5Ta3Re |

at. % except that B is wt. ppm (B is wt. ppm with respect to total weight of a composition of 100% by atom in total consisting of Ni, Al, V, Ta, Re.)

In Table 1, Sample No. 1 to Sample No. 3 are comparative examples, and these samples do not contain Re. (In addition to the sample numbers such as "No. 1", sample names are given by combining the element "Ta" with the Ta content, because the samples contain Ta. For example, the sample containing 5 at. % of Ta is also referred to as "5Ta".)

In Table 1, in addition, Sample No. 4 and Sample No. 5 are examples of the present invention, and these samples contain Re. (Sample names are given in the same manner as in the case of Ta. For example, the sample containing 5 at. % of Ta and 3 at. % of Re is also referred to as "5Ta3Re".)

The proportion of B is presented as a numerical value relative to each composition of 100 at. % in total including Ni, Al, V and Nb in Table 1.

Subsequently, test pieces (approximately 10 mm×5 mm×1 mm) were cut out of the cast materials prepared (No. 1 to No. 5), and the test pieces (No. 1 to No. 5) obtained were given a heat treatment at 1553 K for 5 hours as the solution heat treatment, and then cooled by furnace cooling.

A microstructure of a single A1 phase was formed by the solution heat treatment, and a dual multi-phase microstructure including a primary precipitate $L1_2$ phase, and an $L1_2$ phase and a $D0_{22}$ phase coexisting in channels of the primary precipitate $L1_2$ phase was formed by the subsequent furnace cooling.

Some of the test pieces given the solution heat treatment were further given a heat treatment for forming lower multi-phase microstructure. In order to observe changes in the microstructures due to the heat treatment for forming lower multi-phase microstructure, the test pieces of the respective samples (No. 1 to No. 5) were given the heat treatment for forming lower multi-phase microstructure at a temperature of 1173 K for 5, 10, and 24 hours, and at a temperature of 1223 K for 2, 5, and 24 hours, and water-quenched.

Through the solution heat treatment and the heat treatment for forming lower multi-phase microstructure, the samples treated under the conditions shown in Table 2 were prepared.

TABLE 2

| Condition | Treatment(s) |
|---|---|
| A | Solution heat treatment (temperature; 1553 K, time: 5 hours, furnace cooling) was given. |
| B | Solution heat treatment (same condition as in A) was given, and then heat treatment for forming lower multi-phase microstructure (temperature: 1173 K, water-quenching) was given. Samples given heat treatment for forming lower multi-phase microstructure for 5, 10, and 24 hours were prepared. |
| C | Solution heat treatment (same condition as in A) was given, and then heat treatment for forming lower multi-phase microstructure (temperature: 1223 K, water-quenching) was given. Samples given heat treatment for forming lower multi-phase microstructure for 2, 5, 10 and 24 hours were prepared. |

(Microstructure Observation)

Figure 2:
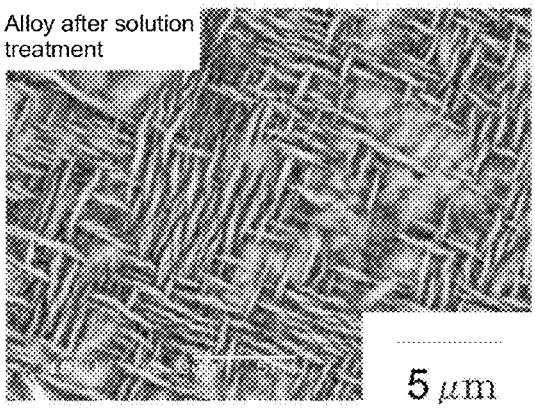
FIG. 2 shows SEM photographs of Sample No. 3 according to a comparative example.
Figure 2:
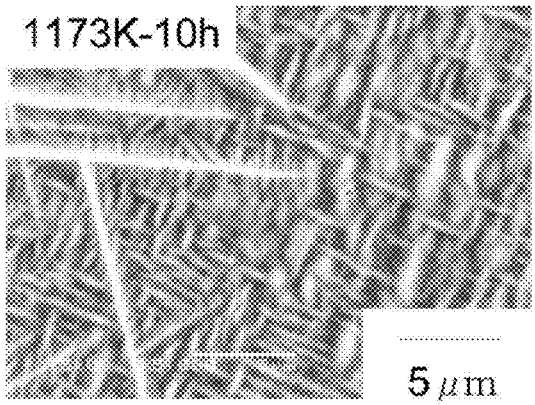
Figure 2:
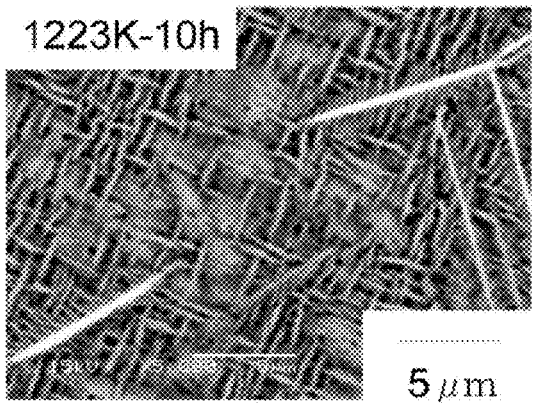
Figure 3:
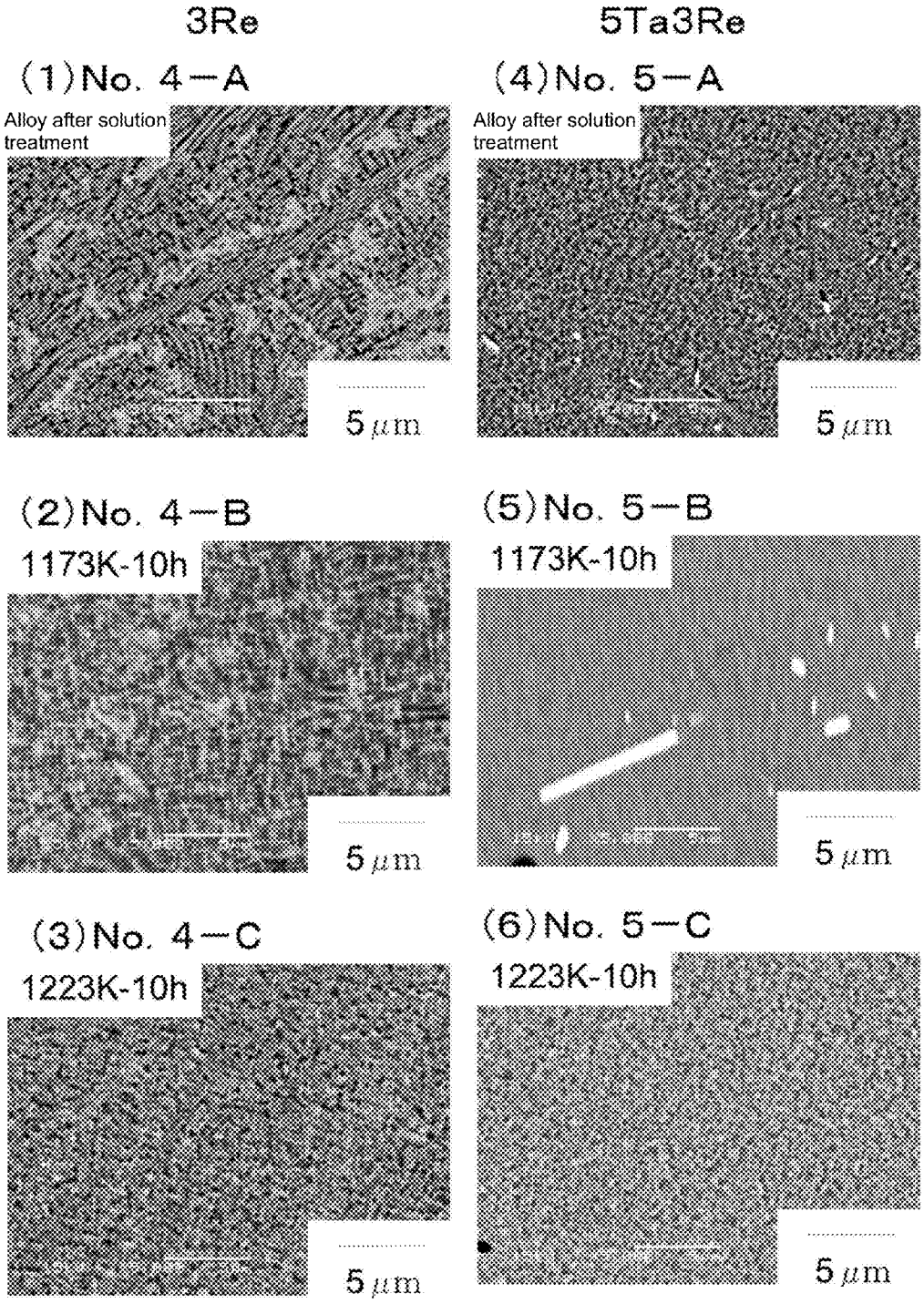
FIG. 3 shows SEM photographs of Sample No. 4 and Sample No. 5 according to examples of the present invention.

Next, microstructure observation by an SEM was performed on the samples after the solution heat treatment or after the heat treatment for forming lower multi-phase microstructure. FIGS. 1 to 3 show the photographs obtained. FIGS. 1 and 2 show SEM photographs of Sample No. 1 to Sample No. 3 (5Ta, 6Ta and 6.5Ta) representing comparative examples, and FIG. 3 shows SEM photographs of Sample No. 4 (3Re) and Sample No. 5 (5Ta3Re) representing examples of the present invention.

In these diagrams, the photographs of the samples given only the solution heat treatment have a caption "alloy after solution treatment" and "-A" representing the condition (condition shown in Table 2) after each Sample No. The photographs of the samples given the heat treatment for forming lower multi-phase microstructure in addition to the solution heat treatment have a caption "1173K-10h", "1223K-10h" or the like saying the conditions of the heat treatment for forming lower multi-phase microstructure. These photographs further have "-B" or "-C" representing their conditions (conditions shown in Table 2) after each Sample No.

FIGS. 1 and 2 show that the samples given only the solution heat treatment out of Sample No. 1 to Sample No. 3 (5Ta, 6Ta and 6.5Ta) include regions of fine and intricate tweed-like microstructures in addition to regions where the dual multi-phase microstructure is formed as observed in (1) No. 1-A and (4) No. 2-A in FIG. 1, and (1) No. 3-A in FIG. 2.

In Sample No. 3 (6.5Ta) given only the solution heat treatment ((1) No. 3-A in FIG. 2), in particular, a tweed-like microstructure having a 4-fold symmetry was observed. This is considered due to the increased Ta content.

In addition, FIGS. 1 and 2 show that the samples given the heat treatment for forming lower multi-phase microstructure in addition to the solution heat treatment out of Sample No. 1 to Sample No. 3 (5Ta, 6Ta and 6.5Ta) ((2) No. 1-B, (3) No. 1-C, (5) No. 2-B and (6) No. 2-C in FIG. 1, and (2) No. 3-B and (3) No. 3-C in FIG. 2) basically have similar characteristics as the samples given only the solution heat treatment, but Sample No. 1 and Sample No. 2 (5Ta and 6Ta) given the heat treatment for forming lower multi-phase microstructure at a temperature of 1223 K ((3) No. 1-C and (6) No. 2-C in FIG. 1) tend to undergo breaking of the 4-fold symmetry in the tweed-like microstructure. In Sample No. 3 (6.5Ta) given the heat treatment for forming lower multi-phase microstructure ((2) No. 3-B and (3) No. 3-C in FIG. 2), in addition, a coarse plate-like second phase dispersion which is considered to be newly formed was confirmed.

On the other hand, FIG. 3 shows that out of Sample No. 4 (3Re) and Sample No. 5 (5Ta3Re), the samples given only the solution heat treatment ((1) No. 4-A and (4) No. 5-A in FIG. 3) are formed of much finer (may be referred to as ultrafine) dual multi-phase microstructures than the dual multi-phase microstructures of the Ni-based alloys in FIGS. 1 and 2 or than conventional dual multi-phase microstructures.

For example, comparison between Sample No. 1 to Sample No. 3 (5Ta, 6Ta and 6.5Ta), and Sample No. 4 (3Re) and Sample No. 5 (5Ta3Re) indicates that Sample No. 4 (3Re) and Sample No. 5 (5Ta3Re) are formed of much finer dual multi-phase microstructures regardless of the heat treatment.

Figure 17:
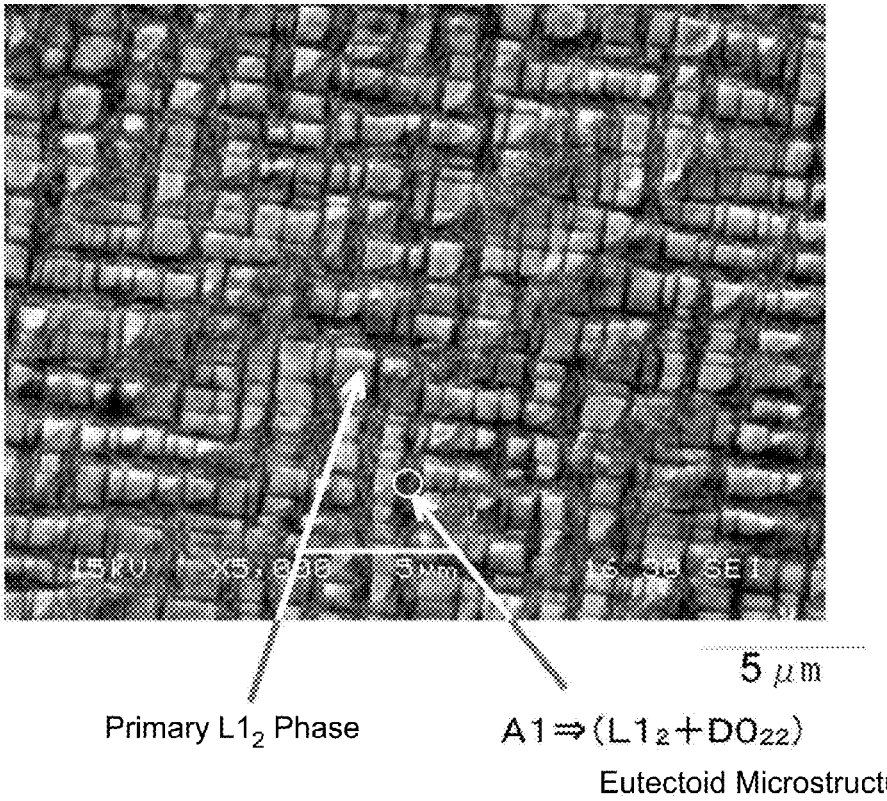
FIG. 17 shows an SEM photograph for illustrating a microstructure of an Ni-based dual multi-phase intermetallic compound alloy and schematic views of crystal structures ($Ni_3Al$, $Ni_3V$) composing the microstructure of the alloy.
Figure 17:
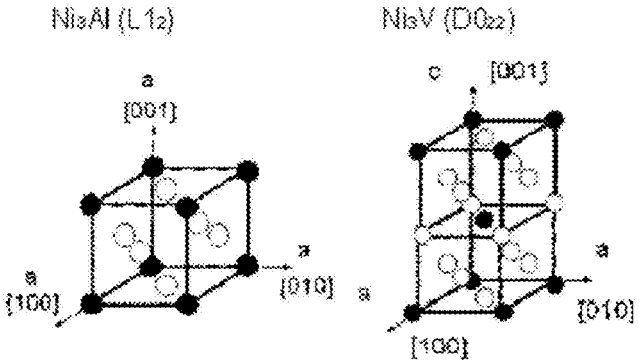

Comparison between (1) No. 4-A in FIG. 3 and FIG. 17 (1) indicates that the length of the sides of the cubic microstructure of (1) No. 4-A in FIG. 3 is approximately half that of the dual multi-phase microstructure of the ($Ni_{75}Al_8V_{14.5}Nb_{2.5}$) in FIG. 17 (1) or less. That is, the size of the microstructure of each sample shown in FIG. 3 is a fraction of that shown in FIG. 17. (For example, Sample (1) No. 4-A in FIG. 3 has a cubic microstructure having sides 0.3 to 0.5 μm in length, whereas the sample shown in FIG. 17 has a cubic microstructure having sides 1 to 2 μm in length.) Thus, it is understood that Sample No. 4 (3Re) and Sample No. 5 (5Ta3Re) are formed of finer dual multi-phase microstructures than the dual multi-phase microstructures disclosed in Patent Documents 3 to 5.

Furthermore, FIG. 3 indicates that Sample No. 4 (3Re) and Sample No. 5 (5Ta3Re), in particular, the samples given the heat treatment for forming lower multi-phase microstructure in addition to the solution heat treatment ((2) No. 4-B, (3) No. 4-C, (5) No. 5-B and (6) No. 5-C in FIG. 3) are interestingly formed of ultrafine dual multi-phase microstructures regardless of whether or not Ta was added.

From these results, it is understood that Re plays a role in maintenance and the size of the dual multi-phase microstructure, and addition of Re allows maintenance of the dual multi-phase microstructure and formation of a finer dual multi-phase microstructure.

In Sample No. 4 (3Re) given only the solution heat treatment, inhomogeneously distributed microstructures were observed which have precipitated into a cubic shape. In Sample No. 4 (3Re) given the heat treatment for forming lower multi-phase microstructure in addition to the solution heat treatment, on the other hand, such cubic microstructures were not observed and the microstructures formed were homogeneous.

(X-Ray Measurement)

Figure 4:
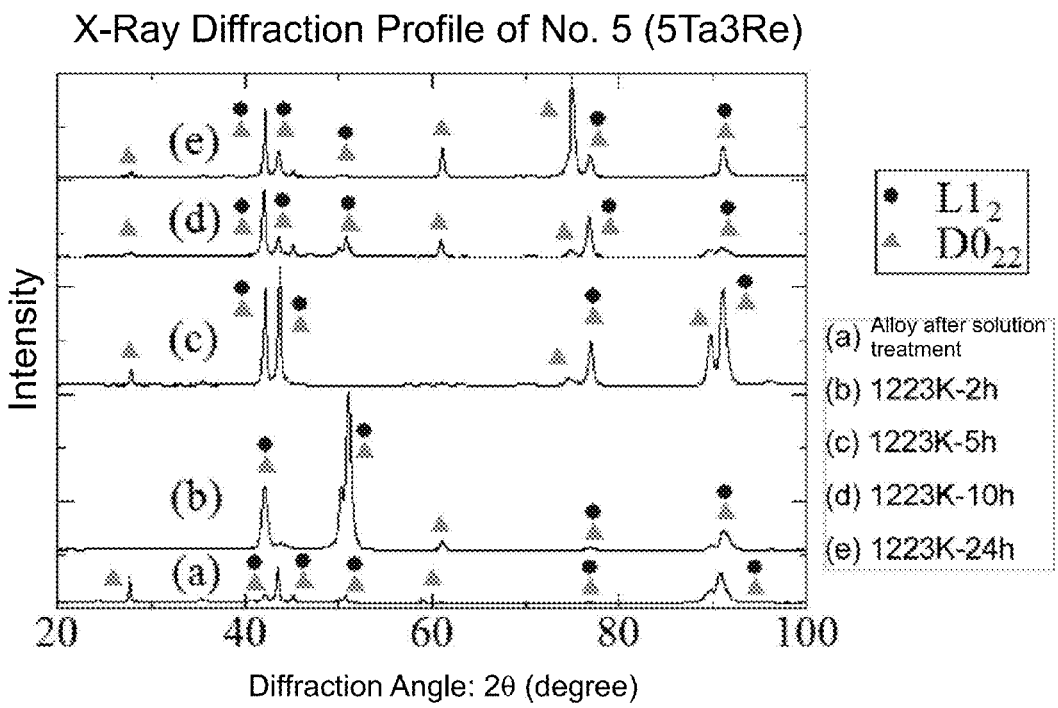
FIG. 4 is a diagram showing an X-ray diffraction profile of No. 5 given a solution heat treatment and a heat treatment for forming lower multi-phase microstructure.

Next, an X-ray measurement was performed on these samples. FIG. 4 shows a result of the measurement on Sample No. 5 (5Ta3Re). FIG. 4 is a diagram showing an X-ray diffraction profile of No. 5 (5Ta3Re) given the solution heat treatment and the heat treatment for forming lower multi-phase microstructure.

In FIG. 4, lines (a) to (e) on the graph represent X-ray diffraction profiles resulting from the respective heat treatments, among which (a) corresponds to the sample given only the solution heat treatment (condition A in Table 2), and (b) to (e) correspond to the respective samples given the heat treatment for forming lower multi-phase microstructure in addition to the solution heat treatment (condition C in Table 2). The heat treatment for forming lower multi-phase microstructure was performed for 2 hours in (b), 5 hours in (c), 10 hours in (d) and 24 hours in (e). In FIG. 4, in addition, circular dots (black circular dots) represent X-ray diffraction peak positions of the $L1_2$ phase ($Ni_3Al$), and triangular dots (gray triangular dots) represent X-ray diffraction peak positions of the $D0_{22}$ phase ($Ni_3V$).

As shown in FIG. 4, $L1_2$ phase peaks and $D0_{22}$ phase peaks were observed in all the samples regardless of the heat treatment, but no other clear peaks were observed, that is, no second phase peaks were observed.

Although examination with a TEM (transmission electron microscope) is needed for an accurate analysis, the result indicates that No. 5 is composed of the $L1_2$ phase and the $D0_{22}$ phase.

(Vickers' Hardness Test)

Next, a Vickers' hardness test was performed on the samples after the solution heat treatment or after the heat treatment for forming lower multi-phase microstructure. The Vickers' hardness was measured at a load of 300 g, 500 g or 1 kg for a retention time of 20 seconds at a room temperature of 25° C. Tables 3 and 4 show the measurement results.

Table 3 shows the Vickers' hardness of the samples given the heat treatment for forming lower multi-phase microstructure at a temperature of 1173 K, and Table 4 shows the Vickers' hardness of the samples given the heat treatment for forming lower multi-phase microstructure at a temperature of 1223 K.

TABLE 3

| Condition | Temperature of Lower Multi-phase Heat Treatment (K) | — | 1173 | 1173 | 1173 |
|---|---|---|---|---|---|
| | Time of Lower Multi-phase Heat Treatment (h) | — | 5 | 10 | 24 |
| Sample No. | No. 1 | 620 | 654 | 644 | 653 |
| | No. 2 | 627 | 636 | 638 | 642 |
| | No. 3 | 606 | 637 | 625 | 631 |
| | No. 4 | 527 | 661 | 663 | 635 |
| | No. 5 | 660 | 801 | 815 | 787 |

Unit: Vickers Hardness (HV)

"—" in the Condition row shows that the sample is not subjected to the aging heat treatment.

Figure 5:
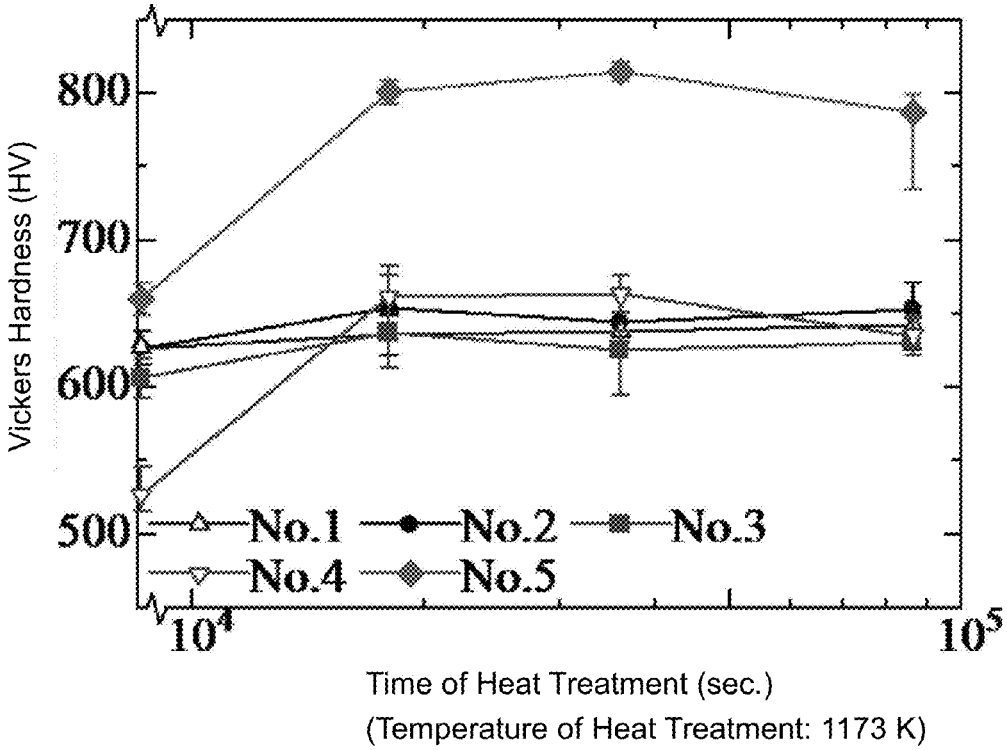
FIG. 5 is a graph showing the relationship between the period of time of the heat treatment for forming lower multi-phase microstructure and the Vickers' hardness for Sample No. 1 to Sample No. 5 given the heat treatment for forming lower multi-phase microstructure (temperature: 1173 K).
Figure 6:
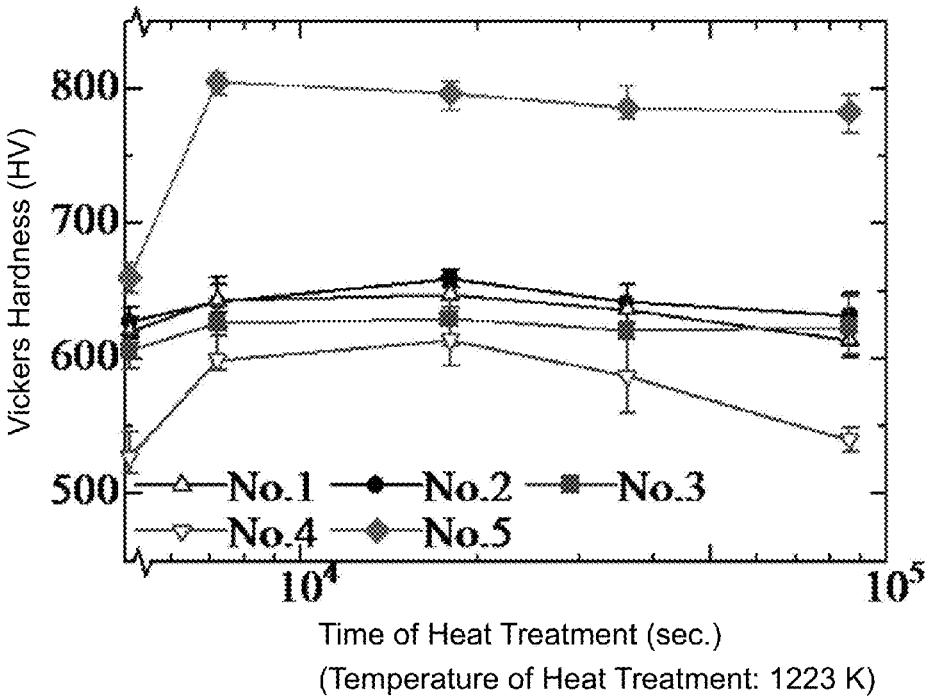
FIG. 6 is a graph showing the relationship between the period of time of the heat treatment for forming lower multi-phase microstructure and the Vickers' hardness for Sample No. 1 to Sample No. 5 given the heat treatment for forming lower multi-phase microstructure (temperature: 1223 K).

FIGS. 5 and 6 are graphs collectively showing the measurement results of the Vickers' hardness test. FIGS. 5 and 6 are to present the measurement results shown in Tables 3 and 4 in a graph form, respectively, showing the relationship between the period of time of the heat treatment for forming lower multi-phase microstructure and the Vickers' hardness for Sample No. 1 to Sample No. 5 given the heat treatment for forming lower multi-phase microstructure. FIG. 5 corresponds to the heat treatment for forming lower multi-phase microstructure at a temperature of 1173 K (condition B shown in Table 2), and FIG. 6 corresponds to the heat treatment for forming lower multi-phase microstructure at a temperature of 1223 K (condition C shown in Table 2). In FIGS. 5 and 6, the Vickers' hardness of the samples given only the solution heat treatment is shown on the left vertical axis.

FIGS. 5 and 6 show that in Sample No. 1 to Sample No. 3 (5Ta, 6Ta and 6.5Ta), the value of the Vickers' hardness makes a moderate peak when the heat treatment for forming lower multi-phase microstructure is performed for approximately 5 hours ($1.8\times10^4$ seconds) regardless of the temperature of the heat treatment for forming lower multi-phase microstructure (temperature: 1173K and 1223K), and then stays almost unchanged (no clear change in the hardness due to the heat treatment for forming lower multi-phase microstructure is observed), though the value tends to gradually decrease (the alloys tend to soften) as the period of time of the heat treatment for forming lower multi-phase microstructure is increased.

In Sample No. 4 (3Re) and Sample No. 5 (5Ta3Re), on the other hand, the value of the Vickers' hardness was significantly increased by the heat treatment for forming lower multi-phase microstructure for several hours (see FIGS. 5 and 6). For example, the value of the Vickers' hardness of Sample No. 4 (3Re) was increased by approximately 130 HV and the value of the Vickers' hardness of Sample No. 5 (5Ta3Re) was increased by approximately 140 HV by the heat treatment for forming lower multi-phase microstructure at 1173 K for 5 hours ($1.8\times10^4$ seconds).

That is, FIGS. 5 and 6 indicate that Sample No. 4 (3Re) and Sample No. 5 (5Ta3Re) show a high Vickers' hardness value when given the heat treatment for forming lower multi-phase microstructure.

For example, Sample No. 4 (3Re) was significantly increased in hardness by the heat treatment for forming lower multi-phase microstructure either at 1173 K or at 1223 K for a short period of time (5 to 10 hours or less than 5 hours, that is, $1.8\times10^4$ to $3.6\times10^4$ seconds or less than $1.8\times10^4$ seconds). In particular, the tendency is evident in the case of the heat treatment for forming lower multi-phase microstructure at 1173 K. Specifically, Sample No. 4 (3Re) showed a hardness of approximately 660 HV when given the heat treatment for forming lower multi-phase microstructure at a temperature of

TABLE 4

| Condition | Temperature of Lower Multi-phase Heat Treatment (K) | — | 1223 | 1223 | 1223 | 1223 |
|---|---|---|---|---|---|---|
| | Time of Lower Multi-phase Heat Treatment (h) | — | 2 | 5 | 10 | 24 |
| Sample No. | No. 1 | 620 | 643 | 648 | 636 | 614 |
| | No. 2 | 627 | 642 | 659 | 642 | 632 |
| | No. 3 | 606 | 626 | 629 | 621 | 623 |
| | No. 4 | 527 | 599 | 614 | 587 | 540 |
| | No. 5 | 660 | 805 | 797 | 786 | 783 |

Unit: Vickers Hardness (HV)

"—" in the Condition row shows that the sample is not subjected to the aging heat treatment.

1173 K for 5 to 10 hours ($1.8\times10^4$ to $3.6\times10^4$ seconds). The hardness is greater than those of Sample No. 1 to Sample No. 3 (5Ta, 6Ta and 6.5Ta). The test results indicate that the heat treatment for forming lower multi-phase microstructure for the samples containing Re is preferably performed either at 1173 K or at 1223 K, and the period of time thereof is preferably 5 to 10 hours.

Sample No. 5 (5Ta3Re) showed a hardness as high as 660 HV even when given only the solution heat treatment, and the value was significantly increased by the heat treatment for forming lower multi-phase microstructure for a short period of time to exceed 800 HV. Although the period of time of the heat treatment for forming lower multi-phase microstructure for the Vickers' hardness to take to reach a peak value differs depending on the temperature, the Vickers' hardness reached a value exceeding 800 HV because of the heat treatment for forming lower multi-phase microstructure both at 1173 K and at 1223 K (the value of the Vickers' hardness was increased by 140 to 150 HV).

The test result indicates that the heat treatment for forming lower multi-phase microstructure for the samples containing Re and Ta is preferably performed both at 1173 K and at 1223 K, and the period of time thereof may be shorter (2 hours or longer).

Incidentally, Sample No. 5 (5Ta3Re) tends to be slightly decreased in hardness when the heat treatment for forming lower multi-phase microstructure is performed for a prolonged period of time. Specifically, the Vickers' hardness fell below 800 HV to a small extent when the heat treatment for forming lower multi-phase microstructure was performed for 24 hours (780 to 790 HV), slightly decreased from the peak value of the Vickers' hardness (decreased by approximately 10 HV in the case of 1173 K and decreased by approximately 20 HV in the case of 1223 K).

However, Sample No. 5 (5Ta3Re) given the heat treatment for forming lower multi-phase microstructure for 24 hours ($8.64\times10^4$ seconds) showed a value of approximately 800 HV, indicating that the hardness is greater than those of Sample No. 1 to Sample No. 3 (5Ta, 6Ta and 6.5Ta) regardless of the conditions of the heat treatment. Even the sample given only the solution heat treatment had a greater hardness than Sample No. 1 to Sample No. 3 (5Ta, 6Ta and 6.5Ta).

The results indicate that Sample No. 5 (5Ta3Re) shows a high Vickers' hardness value when given a heat treatment. That is, it is understood that Sample No. 5 (5Ta3Re) shows an excellent hardness even when given only a solution heat treatment as the heat treatment and shows more excellent hardness when given an aging heat treatment in addition to the solution heat treatment.

It is also understood that the hardness of Sample No. 5 (5Ta3Re) is superior to those of the patent documents. For example, the Ni-based dual multi-phase intermetallic compound alloy disclosed in Patent Document 4 has a hardness of approximately 500 to 650 HV, and the Vickers' hardness of Sample No. 5 (5Ta3Re) exceeds that of the alloy of the patent document by approximately 100 HV or more, which is a remarkable hardness.

As another example, the plasma carburized Ni-based dual multi-phase intermetallic compound alloy disclosed in Patent Document 5 has a hardness of the order of 800 HV in its surface layer (several tens of microns from the surface), and Sample No. 5 (5Ta3Re) has a hardness comparable thereto throughout the sample.

As described above, Sample No. 5 (5Ta3Re) has excellent hardness characteristics.

(Effect Demonstration Experiment 2)

Next, Effect Demonstration Experiment 2 was performed. In Effect Demonstration Experiment 2, cast materials were prepared and given a solution heat treatment and a heat treatment for forming lower multi-phase microstructure (corresponding to the above-mentioned aging heat treatment) to give Ni-based dual multi-phase intermetallic compound alloys, and the resulting alloys were examined for their properties by hardness measurement.

First, cast materials were prepared by melting and casting raw metals of Ni, Al, V, Ta and Re (each having a purity of 99.9% by weight), and B in the proportions shown as No. 6 to No. 12 in Table 5.

Sample No. 6 to Sample No. 11 were formed into ingots (alloys in the form of a small button having a diameter of 30 to 50 mm) through the melting and the casting by an arc melting process as in the case of Effect Demonstration Experiment 1. Sample No. 12 was formed into an ingot (approximately 16.5 mm in diameter×approximately 150 mm in length) through the casting by a ceramic mold process.

TABLE 5

| Sample No. | Ni | Al | V | Ta | Re | B | remarks: name of sample |
|---|---|---|---|---|---|---|---|
| No. 6 | 75 | 8 | 17 | 0 | 0 | 50 | Ta & Re Free |
| No. 7 | 73 | 8 | 17 | 0 | 2 | 50 | 2Re |
| No. 8 | 70 | 8 | 17 | 0 | 5 | 50 | 5Re |
| No. 9 | 75 | 8 | 15 | 2 | 0 | 50 | 2Ta |
| No. 10 | 75 | 8 | 12 | 5 | 0 | 50 | 5Ta* |
| No. 11 | 70 | 8 | 12 | 5 | 5 | 50 | 5Ta5Re |
| No. 12 | 72 | 7 | 13 | 5 | 3 | 50 | 5Ta3Re |

at. % except that B is wt. ppm (B is wt. ppm with respect to total weight of a composition of 100% by atom in total consisting of Ni, Al, V, Ta, Re.)

In Table 5, Sample No. 6, Sample No. 9 and Sample No. 10 are comparative examples, and these samples do not contain Re. In addition, in Table 5, Sample No. 7, Sample No. 8, Sample No. 11 and Sample No. 12 are examples of the present invention, and these samples contain Re. (The samples are named in the same manner as in Effect Demonstration Experiment 1. However, the sample containing 5 at. % of Ta is named "5Ta*" as having different Al and V contents from the "5Ta" in Effect Demonstration Experiment 1. The sample containing no Ta and no Re is named "Ta & Re Free".)

As in the case of Effect Demonstration Experiment 1 in Table 1, the proportion of B is presented as a numerical value relative to each composition of 100 at. % in total including Ni, Al, V and Nb in Table 5.

Next, the cast materials (No. 6 to No. 11) prepared by the arc melting process were given the solution heat treatment at 1553 K for 5 hours, and then water-cooled.

Sample No. 12 was slowly cooled during the casting by the ceramic mold process and exposed for a long period of time to a temperature at which the primary precipitate $L1_2$ phase and the A1 phase coexist, and to a temperature lower than the eutectoid point at which the A1 phase is decomposed into the $L1_2$ phase and the $D0_{22}$ phase, and therefore the solution heat treatment for Sample No. 12 was omitted (hereinafter, the sample for which the solution heat treatment was omitted will be referred to as sample after casting).

Next, the cast materials prepared were sliced by EDM (electrical discharge machining) to make test pieces (approximately 10 mm×5 mm×1 mm). In order to examine the effect of the heat treatment for forming lower multi-phase microstructure, some of the test pieces prepared (No. 6 to No. 12) were given the heat treatment for forming lower multi-phase microstructure at a temperature of 1123 K for 5 hours or the heat treatment for forming lower multi-phase microstructure at a temperature of 1223 K for 5 hours, and then water-quenched. Thus, the samples given only the solution heat treatment (Sample No. 12 was a sample after casting) and the samples given the solution heat treatment and the heat treatment for forming lower multi-phase microstructure (Sample No. 12 was a sample given only the heat treatment for forming lower multi-phase microstructure) were prepared.

Next, a Vickers' hardness test was performed on the samples after the solution heat treatment or after the heat treatment for forming lower multi-phase microstructure. The Vickers' hardness was measured at a load of 1 kg for a retention time of 10 seconds at a room temperature of 25° C. Table 6 shows the measurement results. Table 6 shows conditions of each heat treatment and the Vickers' hardness of the samples given the heat treatment(s).

TABLE 6

| Sample No. (name) | | After solution treatment/ After casting | 1123 K/5 H | 1223 K/5 h |
|---|---|---|---|---|
| No. 6 | Ta & Re Free | 514 | — | 513 |
| No. 7 | 2Re | 586 | 704 | 671 |
| No. 8 | 5Re | 594 | 682 | 598 |
| No. 9 | 2Ta | 546 | 552 | 549 |
| No. 10 | 5Ta* | 615 | 618 | 627 |
| No. 11 | 5Ta5Re | 675 | 710 | 700 |
| No. 12 | 5Ta3Re | 662 | 734 | 752 |

*"—" is marked because "1123 K/5 h" of No. 6 is not measured.

Figure 7:
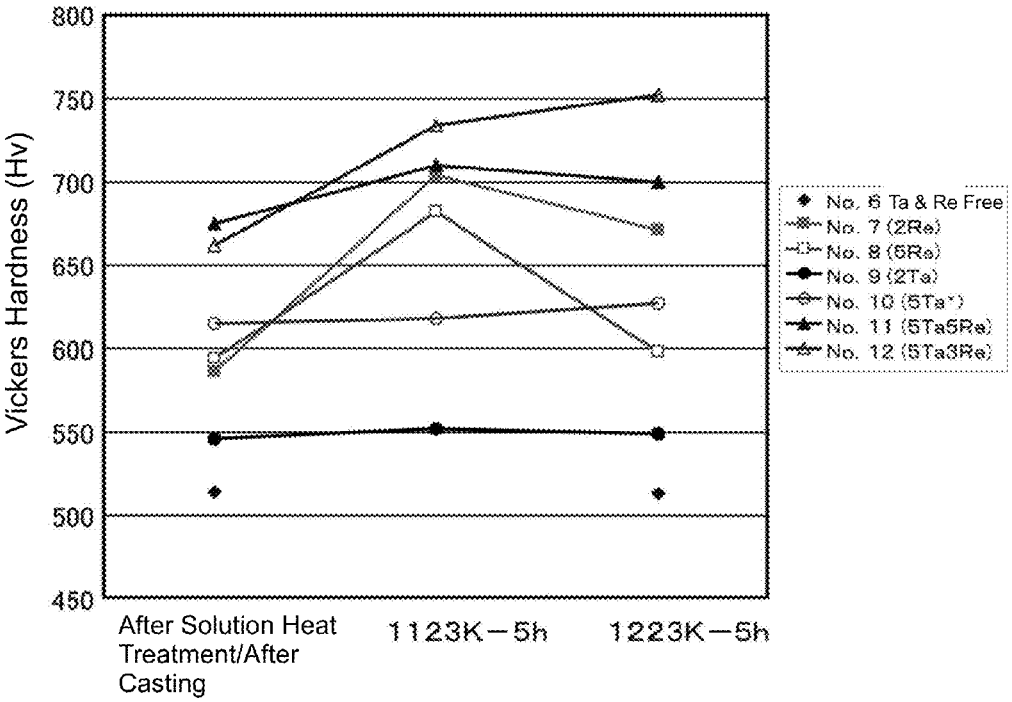
FIG. 7 is a graph showing the relationship between conditions of the heat treatment for forming lower multi-phase microstructure and the Vickers' hardness for Sample No. 6 to Sample No. 12.

FIG. 7 is a graph collectively showing the measurement results of the Vickers' hardness test. FIG. 7 is to present the measurement results shown in Table 6 in a graph form, showing the relationship between the conditions of the heat treatment for forming lower multi-phase microstructure and the Vickers' hardness for Sample No. 6 to Sample No. 12. On the horizontal axis, "After Solution Heat Treatment/After Casting" represents the case where only the solution heat treatment was performed (Sample No. 12 out of Sample No. 6 to Sample No. 12 is the sample after casting), and "1123K-5h" or "1223K-5h" represents the case where the heat treatment for forming lower multi-phase microstructure was further performed at a temperature of 1123 K for 5 hours or at a temperature of 1223 K for 5 hours after the solution heat treatment.

FIG. 7 shows that the Vickers' hardness of Sample No. 7 (2Re) and Sample No. 8 (5Re), and Sample No. 11 (5Ta5Re) and Sample No. 12 (5Ta3Re) is higher than that of Sample No. 6 containing no Ta and no Re (Ta & Re free) regardless of the treatment. For example, Sample No. 7 (2Re) and Sample No. 8 (5Re) had higher Vickers' hardness values than Sample No. 6 by approximately 70 to 80 Hv, and the results indicate that addition of Re to a composition of Ni, Al, V and B improves the Vickers' hardness.

FIG. 7 also shows that the Vickers' hardness of the samples containing Re (No. 7, No. 8, No. 11 and No. 12) is comparable to or greater than that of the samples containing only Ta in addition to Ni, Al, V and B (No. 9 and No. 10). In particular, the Vickers' hardness of the samples containing Ta and Re (Sample No. 11 (5Ta5Re) and Sample No. 12 (5Ta3Re)) was considerably greater than that of the samples containing only Ta. The results indicate that addition of Re to a composition of Ni, Al, V and B improves the Vickers' hardness as in the case of addition of Ta, and further addition of Ta in addition to Re significantly increase the Vickers' hardness.

Furthermore, FIG. 7 indicates that unlike the sample containing no Re (No. 6) and the samples containing only Ta (No. 9 and No. 10), the samples containing Re (No. 7, No. 8, No. 11 and No. 12) are increased in Vickers' hardness when given the heat treatment for forming lower multi-phase microstructure. The samples were increased in Vickers' hardness by the heat treatment for forming lower multi-phase microstructure regardless of the temperature. In particular, all the samples containing Re were considerably increased in Vickers' hardness in the case of the heat treatment for forming lower multi-phase microstructure at 1123 K. It is also indicated that the samples containing Ta and Re (No. 11 and No. 12) tend to be increased in Vickers' hardness by the heat treatment for forming lower multi-phase microstructure regardless of the temperature.

(Effect Demonstration Experiment 3)

Next, in order to observe in detail the effects of the solution heat treatment and the heat treatment for forming lower multi-phase microstructure on the microstructures of the samples in Effect Demonstration Experiment 1, microstructure observation was performed on No. 4 and No. 5 prepared in the same manner as in Effect Demonstration Experiment 1.

In addition, the microstructure observation was performed also on Sample No. 13 prepared as a comparative example by melting and casting raw metals of Ni, Al, V, Ta and Re (each having a purity of 99.9% by weight), and B in the proportions shown in Table 7.

TABLE 7

| Sample No. | Ni | Al | V | Ta | Re | B | remarks: name of sample |
|---|---|---|---|---|---|---|---|
| No. 13 | 75 | 7 | 13 | 5 | 0 | 50 | 5Ta** |

at. % except that B is wt. ppm (B is wt. ppm with respect to total weight of a composition of 100% by atom in total consisting of Ni, Al, V, Ta, Re.)

Sample No. 13 was prepared by the same casting as in Effect Demonstration Experiments 1 and 2, and the solution heat treatment and the heat treatment for forming lower multi-phase microstructure were performed on the samples including Sample No. 13 (No. 4, No. 5 and No. 13) under the conditions A and C in Effect Demonstration Experiment 1 (the heat treatment for forming lower multi-phase microstructure was performed at 1223 K for 2 hours).

Figure 8:
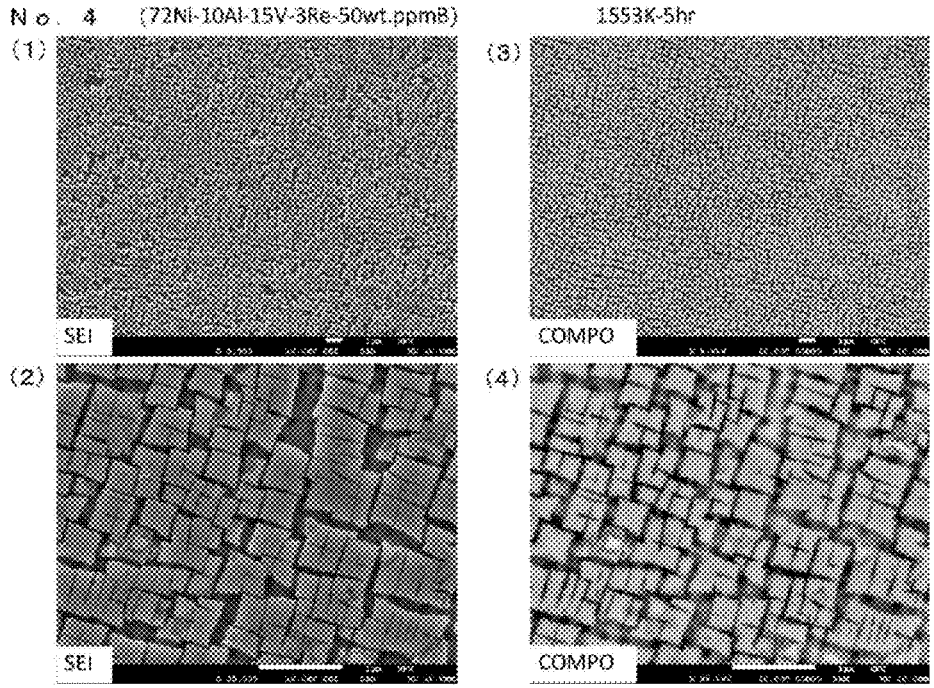
FIG. 8 shows SEM photographs of Sample No. 4 according to the example of the present invention which was given the solution heat treatment.
Figure 9:
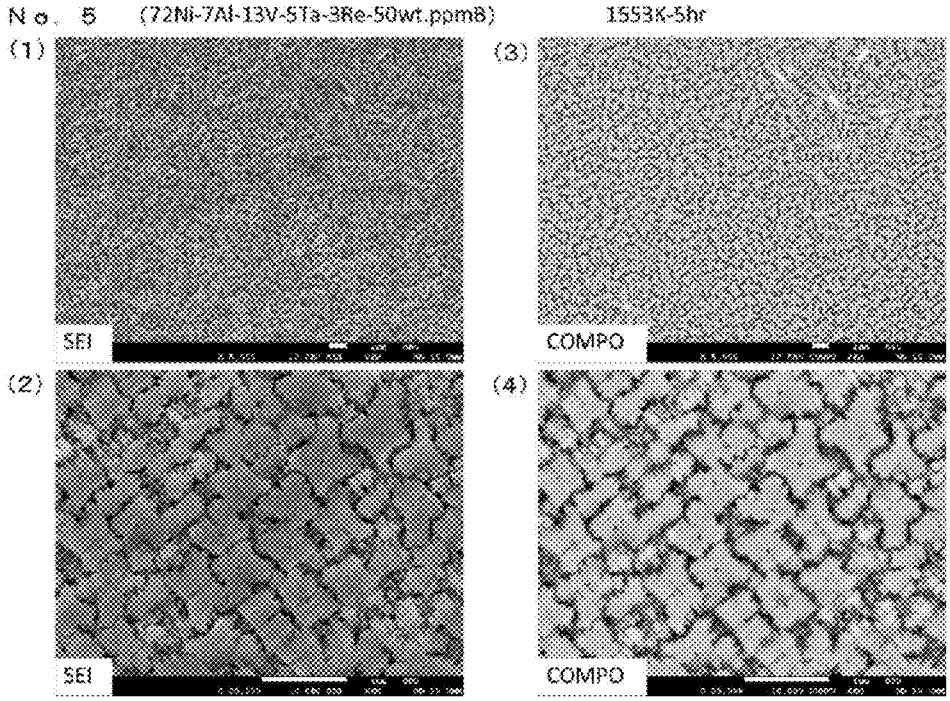
FIG. 9 shows SEM photographs of Sample No. 5 according to the example of the present invention which was given the solution heat treatment.
Figure 10:
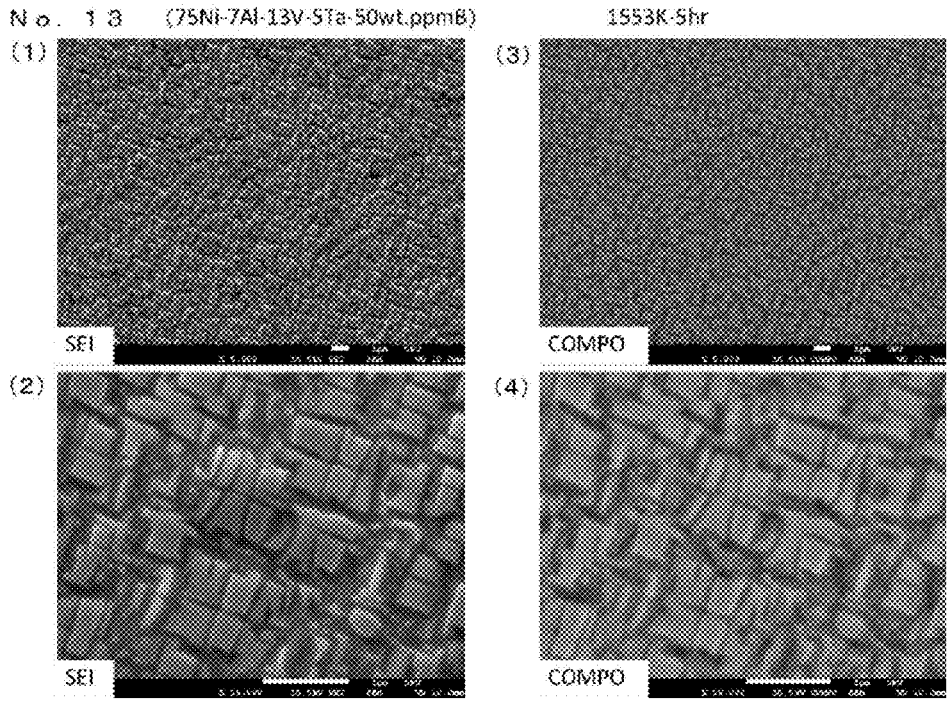
FIG. 10 shows SEM photographs of Sample No. 13 according to a comparative example which was given the solution heat treatment.
Figure 11:
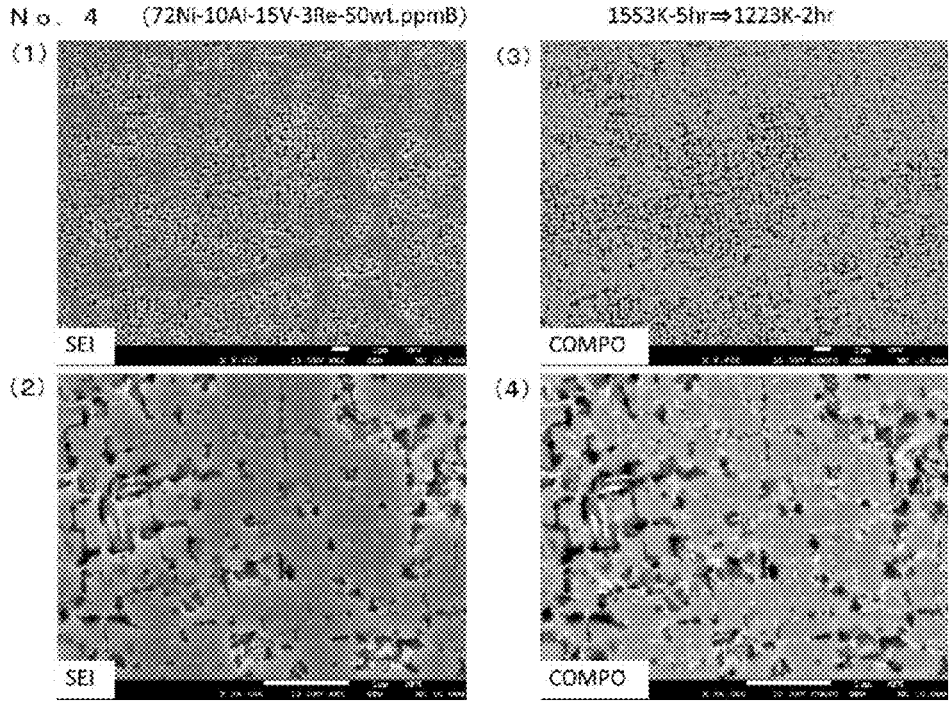
FIG. 11 shows SEM photographs of Sample No. 4 according to the example of the present invention which was given the solution heat treatment and the heat treatment for forming lower multi-phase microstructure (temperature: 1223 K, time: 2 hours).
Figure 12:
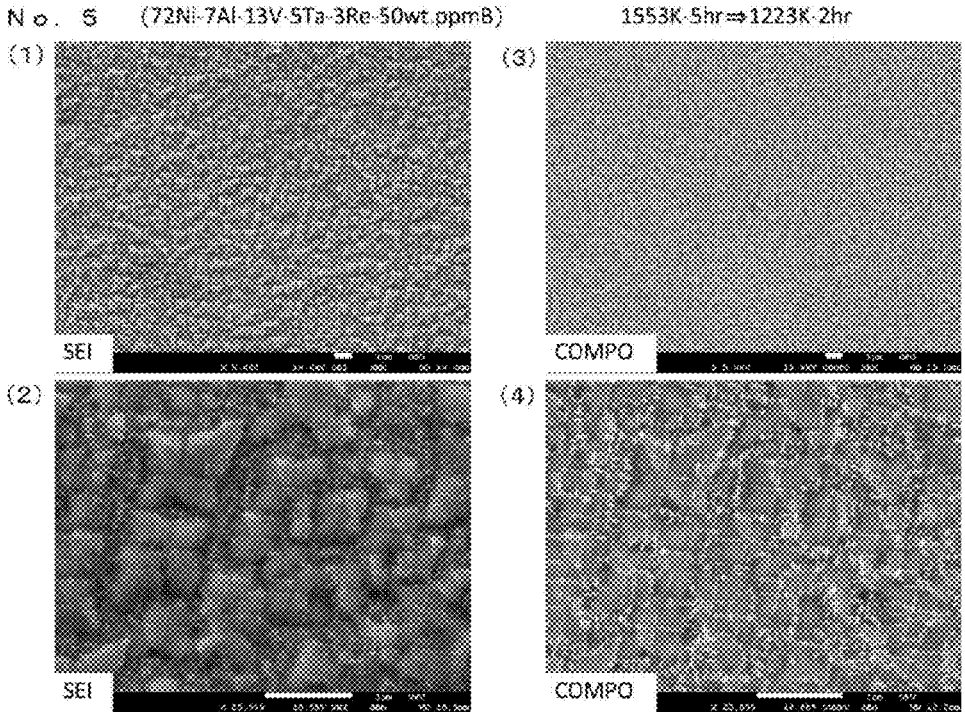
FIG. 12 shows SEM photographs of Sample No. 5 according to the example of the present invention which was given the solution heat treatment and the heat treatment for forming lower multi-phase microstructure (temperature: 1223 K, time: 2 hours).
Figure 13:
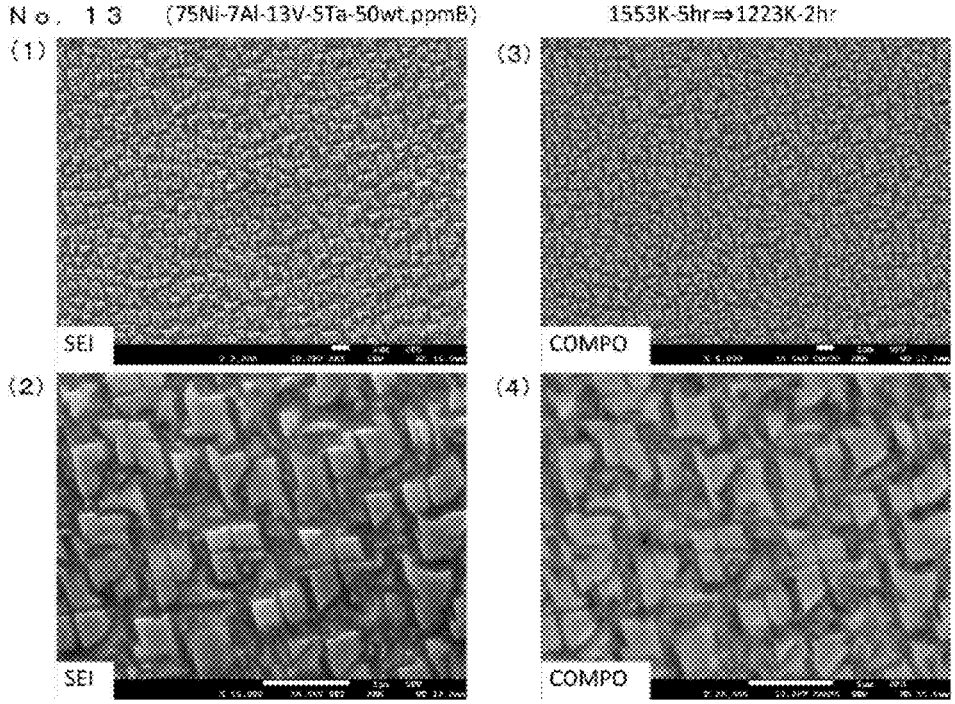
FIG. 13 shows SEM photographs of Sample No. 13 according to the comparative example which was given the solution heat treatment and the heat treatment for forming lower multi-phase microstructure (temperature: 1223 K, time: 2 hours).
Figure 14:
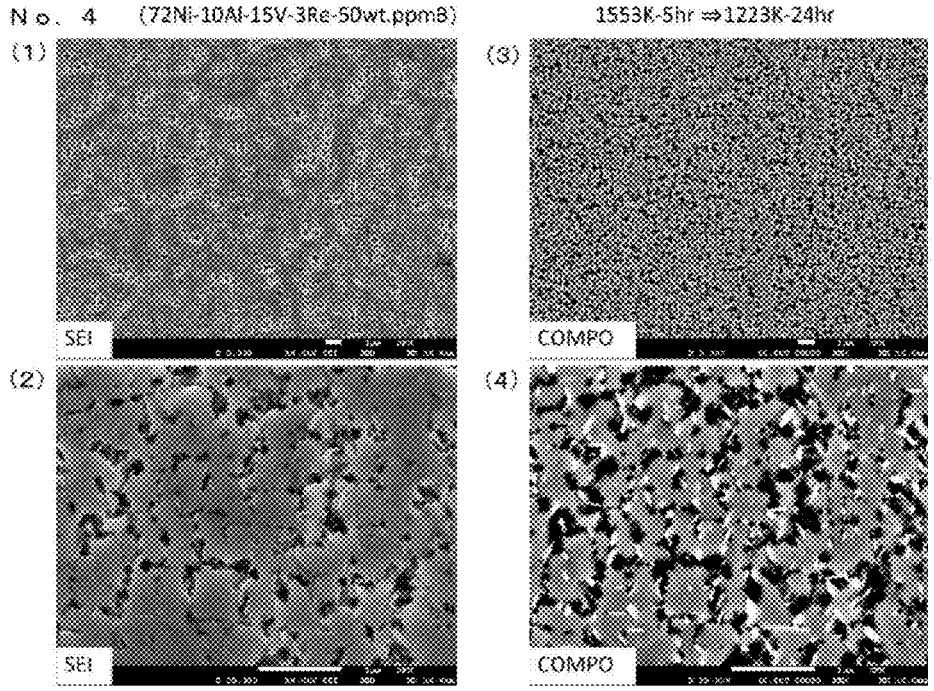
FIG. 14 shows SEM photographs of Sample No. 4 according to the example of the present invention which was given the solution heat treatment and the heat treatment for forming lower multi-phase microstructure (temperature: 1223 K, time: 24 hours).
Figure 15:
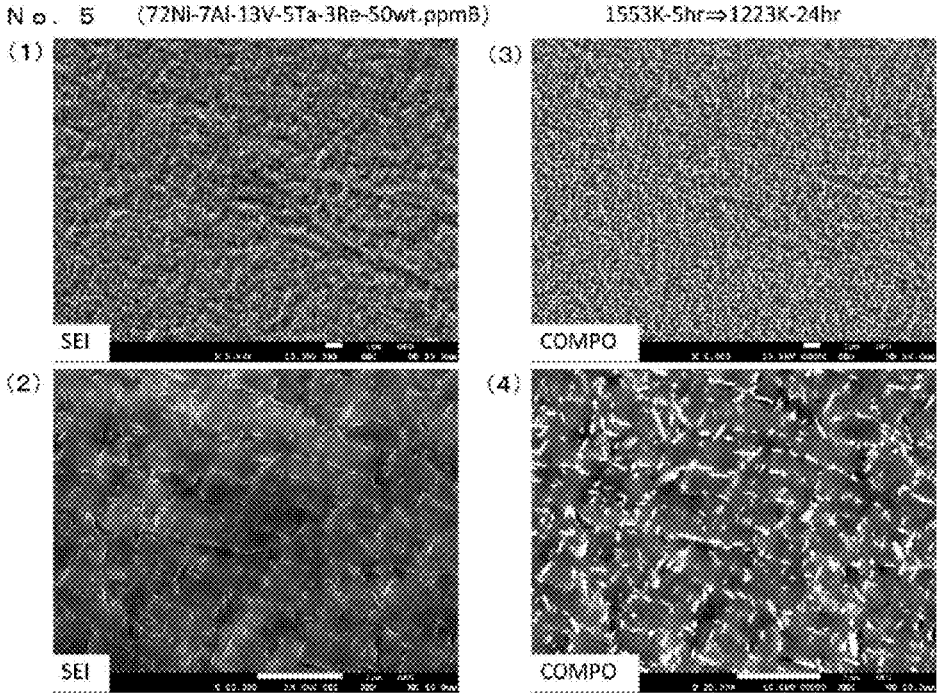
FIG. 15 shows SEM photographs of Sample No. 5 according to the example of the present invention which was given the solution heat treatment and the heat treatment for forming lower multi-phase microstructure (temperature: 1223 K, time: 24 hours).
Figure 16:
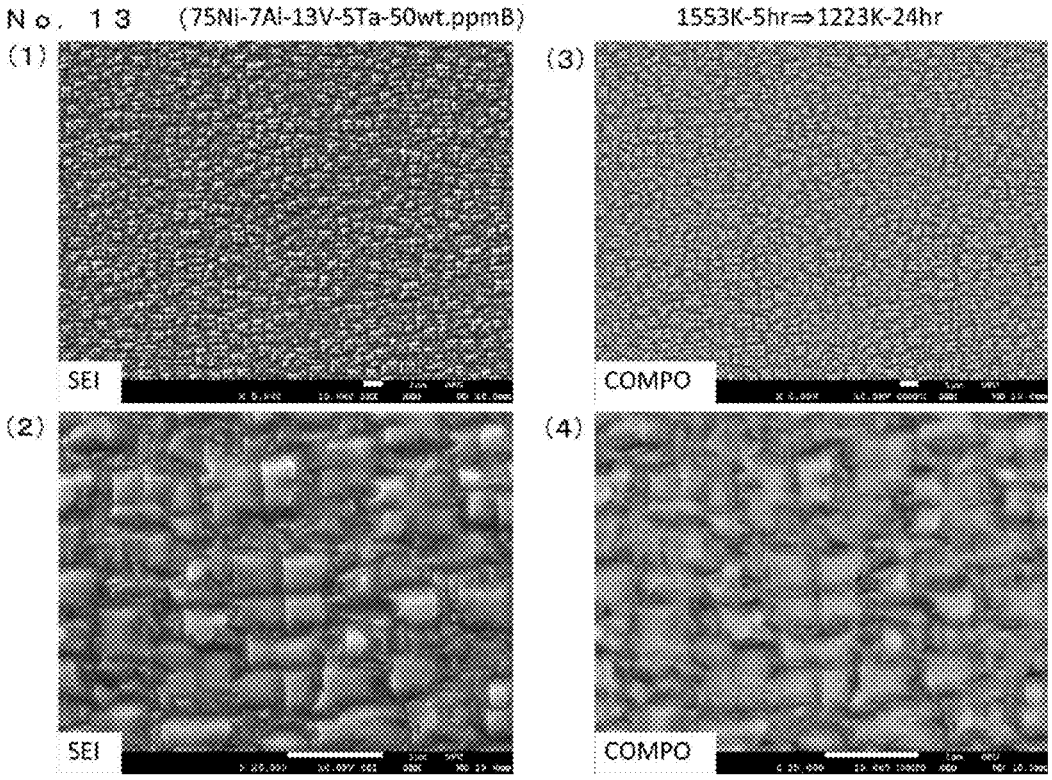
FIG. 16 shows SEM photographs of Sample No. 13 according to the comparative example which was given the solution heat treatment and the heat treatment for forming lower multi-phase microstructure (temperature: 1223 K, time: 24 hours).

FIGS. 8 to 16 show the observation results. FIGS. 8 to 16 are SEM photographs of Sample No. 4, Sample No. 5 and Sample No. 13. FIGS. 8 to 10 are photographs of the samples given the solution heat treatment, FIGS. 11 to 13 are photographs of the samples given the solution heat treatment and the heat treatment for forming lower multi-phase microstructure (temperature: 1223 K, time: 2 hours), and FIGS. 14 to 16 are photographs of the samples given the solution heat treatment and the heat treatment for forming lower multi-phase microstructure (temperature: 1223 K, time: 24 hours). Out of the photographs in FIGS. 8 to 16, (1) and (2) are secondary electron images (SEI), (3) and (4) are compositional images (COMPO), (1) and (3) are images at a magnification of 5000 times, and (2) and (4) are images at a magnification of 25000 times.

FIGS. 8 to 10 show that a dual multi-phase microstructure is formed in all the samples given only the solution heat treatment. That is, like the dual multi-phase microstructure shown in FIG. 17 (1), the samples are composed of a submicron-sized primary precipitate $L1_2$ phase and a nano-level structure (eutectoid structure) formed in channels of the primary precipitate $L1_2$ phase.

In addition, FIGS. 11 to 13 indicate that the microstructure of Sample No. 13 hardly changed, maintaining its dual multi-phase microstructure, even given the heat treatment for forming lower multi-phase microstructure (temperature: 1223 K) for 2 hours in addition to the solution heat treatment. On the other hand, it is indicated that acicular second phase particles were formed mainly in the eutectoid microstructure between the primary precipitate $L1_2$ phases in the samples containing Re, that is, Sample No. 4 and Sample No. 5 given the heat treatment for forming lower multi-phase microstructure (temperature: 1223 K) for 2 hours in addition to the solution heat treatment (white acicular microstructures in FIG. 11 (4) and FIG. 12 (4)).

Furthermore, FIGS. 14 and 16 show the same phenomenon as observed in FIGS. 11 to 13. Sample No. 13 hardly changed in microstructure even given the heat treatment for forming lower multi-phase microstructure (temperature: 1223 K) extended from 2 hours to 24 hours. In the samples containing Re, that is, No. 4 and No. 5 given the heat treatment for forming lower multi-phase microstructure (temperature: 1223 K) for the extended period of time, on the other hand, the second phase (acicular particles) observed in FIGS. 11 to 13 became more clearly observable (the acicular particles were coarsened).

The results indicate that in the samples containing Re (No. 4 and No. 5), the acicular second phase particles were formed in the eutectoid microstructure formed between the primary precipitate $L1_2$ phases through the heat treatment for forming lower multi-phase microstructure. Supposedly, such a structural change plays a role in the change in the Vickers' hardness.

INDUSTRIAL APPLICABILITY

The present invention provides an Ni-based dual multi-phase intermetallic compound alloy having excellent hardness. In addition, the Ni-based intermetallic compound alloy is improved in hardness by an aging heat treatment and shows excellent hardness even at high temperature. Accordingly, the Ni-based intermetallic compound alloy is useful as a material of high-temperature mechanical structures such as refractory bolts, jet engines and gas turbines.

The invention claimed is:

1. An Ni-based intermetallic compound alloy comprising Ni as a main component, and 5 to 9 atomic % of Al, 11 to 15 atomic % of V, 3 to 7 atomic % of Ta and 1 to 5 atomic % of Re, and having a microstructure including a primary precipitate $L1_2$ phase and a ($L1_2$+$D0_{22}$) eutectoid microstructure.

2. An Ni-based intermetallic compound alloy comprising:

a composition of 100 atomic % in total comprising Ni as a main component, 5 to 12 atomic % of Al, 11 to 17 atomic % of V, 3 to 7 atomic % of Ta and 1 to 5 atomic % of Re, and 10 to 1000 ppm by weight of B with respect to the total weight of the composition, wherein the alloy has a microstructure including a primary precipitate $L1_2$ phase and a ($L1_2$+$D0_{22}$) eutectoid microstructure.

* * * * *